US007188993B1

(12) United States Patent
Howe et al.

(10) Patent No.: US 7,188,993 B1
(45) Date of Patent: Mar. 13, 2007

(54) APPARATUS AND METHOD FOR RESONANT-VIBRATORY MIXING

(76) Inventors: Harold W Howe, Resodyn Corp, 1901 S. Franklin St., Butte, MT (US) 59701; Jeremiah J Warriner, Resodyn Corp, 1901 S. Franklin St., Butte, MT (US) 59701; Aaron M Cook, Resodyn Corp, 1901 S. Franklin St., Butte, MT (US) 59701; Scott L Coguill, Resodyn Corp, 1901 S. Franklin St., Butte, MT (US) 59701; Lawrence C Farrar, Resodyn Corp, 1901 S. Franklin St., Butte, MT (US) 59701

( * ) Notice: Subject to any disclaimer, the term of this patent is extended or adjusted under 35 U.S.C. 154(b) by 286 days.

(21) Appl. No.: 10/766,558

(22) Filed: Jan. 26, 2004

Related U.S. Application Data

(60) Provisional application No. 60/443,051, filed on Jan. 27, 2003.

(51) Int. Cl.
*B01F 11/00* (2006.01)

(52) U.S. Cl. ..... 366/111; 366/128; 366/212

(58) Field of Classification Search ..... 366/110–114, 366/128, 208–209, 212; 74/86–87
See application file for complete search history.

(56) References Cited

U.S. PATENT DOCUMENTS

| | | | | |
|---|---|---|---|---|
| 1,908,104 | A | * | 5/1933 | Bell |
| 2,091,414 | A | | 8/1937 | Newport et al. |
| 2,353,492 | A | | 7/1944 | O'Connor |
| 2,636,719 | A | | 4/1953 | O'Connor |
| 2,653,521 | A | * | 9/1953 | Ahlfors |
| 3,162,910 | A | | 12/1964 | Behnke et al. |
| 3,215,209 | A | * | 11/1965 | DesVaux et al. |
| 3,498,384 | A | | 3/1970 | Ogura |
| 3,583,246 | A | | 6/1971 | Stahle et al. |
| 3,767,168 | A | | 10/1973 | Dupre et al. |
| 4,288,165 | A | * | 9/1981 | Fewel |
| 4,619,532 | A | | 10/1986 | Schmidt |
| 4,972,930 | A | | 11/1990 | Davis |
| 5,833,362 | A | * | 11/1998 | Shepard |
| 5,979,242 | A | | 11/1999 | Hobbs |
| 6,213,630 | B1 | | 4/2001 | Kossmann |
| 6,250,792 | B1 | | 6/2001 | Krush et al. |
| 6,263,750 | B1 | | 7/2001 | Maurer et al. |
| 6,579,002 | B1 | | 6/2003 | Bartick et al. |

FOREIGN PATENT DOCUMENTS

| | | | |
|---|---|---|---|
| JP | 9-52039 | * | 2/1997 |
| JP | 10-34084 | * | 2/1998 |

* cited by examiner

*Primary Examiner*—Charles E. Cooley
(74) *Attorney, Agent, or Firm*—Robert M. Hunter

(57) ABSTRACT

An apparatus and method for mixing fluids and/or solids in a manner that can be varied from maintaining the integrity of fragile molecular and biological materials in the mixing vessel to homogenizing heavy aggregate material by supplying large amounts of energy. Variation in the manner of mixing is accomplished using an electronic controller to generate signals to control the frequency and amplitude of the motor(s), which drive an unbalanced shaft assembly to produce a linear vibratory motion. The motor may be a stepper motors a linear motor or a DC continuous motor. By placing a sensor on the mixing vessel platform to provide feedback control of the mixing motor, the characteristics of agitation in the fluid or solid can be adjusted to optimize the degree of mixing and produce a high quality mixant.

36 Claims, 11 Drawing Sheets

APPARATUS AND METHOD FOR RESONANT-VIBRATORY MIXING

CROSS-REFERENCE TO RELATED APPLICATIONS

This application claims the benefit of U.S. Provisional Application No. 60/443,051, filed Jan. 27, 2003, the disclosure of which application is incorporated by reference as if fully set forth herein.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. DAAH01-00-C-R086 awarded by U.S. Army.

BACKGROUND OF THE INVENTION

This invention relates generally to mixing and mass transport. In particular, the invention relates to an apparatus and method for resonant-vibratory mixing.

The mixing of fluids involves the creation of fluid motion or agitation resulting in the uniform distribution of either heterogeneous or homogeneous starting materials to form an output product. Mixing processes are called upon to effect the uniform distribution of: miscible fluids such as alcohol in water; immiscible fluids such as the emulsification of oil in water; of particulate matter such as the suspension of pigment particles in a carrier fluid; mixtures of dry materials with fluids such as sand, cement and water; thixotropic (pseudo plastic) fluids with solid particulates; the chemical ingredients of pharmaceuticals; and biological specimens, such as bacteria, while growing in a nurturing media without incurring physical damage.

Mixing may be accomplished in a variety of ways: either a rotating impeller(s) mounted onto a shaft(s) immersed in the fluid mixture agitate(s) the fluid and/or solid materials to be mixed, or a translating perforated plate does the agitation, or the vessel itself containing the materials is agitated, shaken or vibrated. Mixing may be continuous (as when a rotating impeller is used or the containing vessel is vibrated) or intermittent as when the drive mechanism starts and stops in one or several directions.

With a conventional vibrational mixer, the amplitude can be varied within very narrow limits, and the frequency is generally set at the frequency of the alternating current (AC) power source. Even when using a motor controller with frequency control, the vibrational frequency of a conventional vibrational mixer can be varied only within relatively narrow limits. Mixing at the natural resonant frequency of the mechanism is usually avoided do to the high loads and associated wear of the mechanisms.

When biological tissue is cultivated, all cells must stay suspended in the nutrient broth; that is, the cells should not settle to the bottom of the vessel in which they are cultivated. However, in agitating living cells so as to minimize sedimentation, the mechanical effect of high shear caused by the agitator should not compromise the integrity of the cells. In the case of rotating agitators, quite often the culture medium creates a turbulent vortex into which the cells are sucked. Under the turbulent vortex conditions, the cells are at greater risk of being mechanically damaged and the continuous supply of oxygen to the cells is not consistently assured.

The background art is characterized by U.S. Pat. Nos. 2,091,414; 3,162,910; 2,353,492; 2,636,719; 3,498,384; 3,583,246; 3,767,168; 4,619,532; 4,972,930; 5,979,242; 6,213,630; 6,250,792; 6,263,750; and 6,579,002; the disclosures of which patents are incorporated by reference as if fully set forth herein.

Newport et al. in U.S. Pat. No. 2,091,414 disclose an apparatus for effecting vibration. This invention is limited in that only a single-mass system is disclosed.

Behnke et al. in U.S. Pat. No. 3,162,910 disclose a apparatus for shaking out foundry flasks. This invention is limited in that only a single-mass system and a single set of springs is provided.

The present invention overcomes the limitations of U.S. Pat. Nos. 2,353,492 and 2,636,719 issued to John C. O'Connor (the "O'Conner patents") and U.S. Pat. No. 6,213,630 issued to Olga Kossman (the "Kossman patent"). The O'Conner patents disclose devices, which provide for the vibrational compaction of dry materials and for the feeding of material via a vibratory conveyance. The Kossman patent claims electronic control of motors for the purpose of vibrational control of a compaction device.

The O'Conner patents disclose vibrational mechanisms comprised of two masses. A means of imposing a cyclical force is attached to the first mass. The second mass, which holds or includes the material to be affected, is resiliently mounted to the first. The assembly is then held by resilient members to a fixed ground position. This mechanism can be effectively tuned by proper resilient member selections to substantially reduce transmitted forces to the ground position but is limited in its ability to reduce accelerations imposed on the first mass. Accelerations on the first mass, which includes the driver inducing the cyclical forces, induce high forces which in turn lead to premature failures. To lower the failure rates of the driver, either the induced forces must be reduced or the mass of the material to be affected must be severely limited. Both cases limit the available applications of the device. Further, it is stated that the preferred operating conditions are between the first and second modes of peak vibrations. This further limit the device's effectiveness due to the additional power required to operate in this range for optimum mixing accelerations and amplitudes. If the device were to operate at one of the peek modes only enough power to overcome inherent damping of the device would be required to effect maximum acceleration and amplitude at mass two.

The Kossman patent discloses a method of controlling the driver motor or motors of a vibrational device similar to the O'Conner patent. The desclosed device lacks the ability to operate at the natural frequency peaks and also suffers from a lack of ability to limit transmitted forces to either the driver or ground positions.

Ogura in U.S. Pat. No. 3,498,384 discloses a vibratory impact device. This invention is limited in that only a two-mass system is disclosed. It is not possible to achieve high payload accelerations, force cancellation and low driver accelerations with a two-mass system.

Stahle et al. in U.S. Pat. No. 3,583,246 disclose a vibration device driven by at least one imbalance generator. This invention is limited in that only a single-mass system is disclosed.

Dupre et al. in U.S. Pat. No. 3,767,168 disclose a mechanical agitation apparatus. This invention is limited in that only a single-mass system is disclosed.

Schmidt in U.S. Pat. No. 4,619,532 discloses a shaker for paint containers. This invention is limited in that only a double-mass system is disclosed.

Davis in U.S. Pat. No. 4,972,930 discloses a dynamically adjustable rotary unbalance shaker. This invention is limited in that only a single-mass system is disclosed. Moreover, the vibratory driver is directly attached to the single mass and this mass is attached to ground by pneumatic springs. High driver accelerations are an unavoidable result of such a device.

Hobbs in U.S. Pat. No. 5,979,242 discloses a multi-level vibration test system having controllable vibration attributes. This invention is limited in that it discloses a multi-driver system with a driver attached on each of the masses in the system. No disclosure of means for achieving low driver accelerations or low transmitted forces to ground is made.

Krush et al. in U.S. Pat. No. 6,250,792 discloses an integrated vibratory adapter device. This invention is limited in that only a single-mass system is disclosed.

Maurer et al. in U.S. Pat. No. 6,263,750 disclose a device for generating directed vibrations. This invention is limited in that only a single-mass system is disclosed.

Bartick et al,. in U.S. Pat. No. 6,579,002 disclose a broad-range large-load fast-oscillating high-performance reciprocating programmable laboratory shaker. This invention is limited in that only a single-mass system is disclosed. This invention is not capable of operating in a resonant condition as it is displacement rather than vibration driven.

In summary, the background art does not teach a three-mass system having a structure that is capable of achieving low-frequencies of 0–1000 Hertz (Hz), high accelerations of 2–75 accelerations equal to that caused by gravity (g's) and large displacement amplitudes of 0.01–0.5 inches. What is needed is an apparatus and method for mixing fluids and/or solids in a manner that can be varied from maintaining the integrity of fragile molecular and biological materials in the mixing vessel to homogenizing heavy aggregate material by supplying large amounts of energy.

BRIEF SUMMARY OF THE INVENTION

The purpose of the invention is to provide intimate processing, for example, mixing a plurality of fluids, e.g., intimately mixing a gas in a liquid, or a liquid in another liquid, or more than two phases. One application is the mixing and dispersion of solids in liquids, in particular hard to wet solids and small particles. Other applications include preparing emulsions for chemical and pharmaceutical applications, gasifying liquids for purification and for chemical reactions, accelerating physical and chemical reactions, and suspending fine particles in fluids. The fluids to which reference is made herein may or may not include entrained solid particles.

The present invention provides an apparatus and method for mixing materials, which apparatus and method afford exquisite control over mixing in a wide range of applications. The range of applications extends from heavy-duty agitation for preparation of concrete to delicate and precise mixing required for the preparation of pharmaceuticals and the processing of biological cultures in which living organisms must remain viable through the mixing process. In a preferred embodiment, the present invention provides a vibration mixer, driven by an electronically controllable motor or motors, adapted so as to allow virtually unlimited control of the mixing process.

In a preferred embodiment, the present invention is comprised of three masses with a cyclical linear force applied to one of the masses. The linear force applied to the first mass produces a vibratory motion which is transmitted through resilient members to a second coupling mass then to a third mass. By adding a second mass, it is possible to tune the response of the system so that transmitted forces are cancelled out. A vessel is attached to the second or third mass for the purpose of mixing two or more constituents. The three masses are coupled together with resilient members which are optimized to transfer the vast majority of the force to the mixing vessel and minimize the transmitted force to the ground and supporting structure. Minimizing the transmission of force to ground and maximizing the transmitted force to the vessel most efficiently affects work done on the vessel contents and reduces wear on the linear force transducer. Most efficient operation is achieved by operation at or near resonant frequencies of the mechanism. Levels of intensity that are nearly impossible with conventional methods of vibration mixing are attained with ease by employing the resonating system disclosed herein.

One object of preferred embodiments of the invention is to facilitate mixing of two or more liquids. Another object of preferred embodiments of the invention is to facilitate mixing of one or more liquids and one or more gases. Yet another object of preferred embodiments of the invention is to facilitate mixing of one or more liquids and one or more gases. Another object of preferred embodiments of the invention is to facilitate mixing of one or more liquids with one or more solid particles. A further object of preferred embodiments of the invention is to facilitate mixing of one or more liquids with one or more solid particles with one or more gases. Yet another object of preferred embodiments of the invention is to facilitate mixing of two or more solids. Another object of preferred embodiments of the invention is to facilitate mixing of two or more non-Newtonian materials. A further object of preferred embodiments of the invention is to facilitate mixing of one or more non-Newtonian materials with one or more solid particles.

Another object of preferred embodiments of the invention is to facilitate gasification of liquids. Yet another object of preferred embodiments of the invention is to facilitate de-gasification of liquids. Another object of preferred embodiments of the invention is to accelerate physical and chemical reactions. A further object of preferred embodiments of the invention is to accelerate heat transfer. Another object of preferred embodiments of the invention is to accelerate mass transfer. Yet another object of preferred embodiments of the invention is to suspend and distribute particles. A further object of preferred embodiments of the invention is to suspend nanoparticles distribute particles. Another object of preferred embodiments of the invention is to cause micromixing. Another object of preferred embodiments of the invention is to create Newtonian instabilities. Yet another object of preferred embodiments of the invention is to cause high rates of gas-liquid and liquid-gas mass transfer. Another object of preferred embodiments of the invention is to cause dispersion of vapor bubbles into the surface and disperse into the liquid. A further object of preferred embodiments of the invention is to cause bubbles to move downward into a liquid. Another object of preferred embodiments of the invention is to cause bubbles to be suspended in a liquid. Another object of preferred embodiments of the invention is to cause vapor to cavitate in a liquid.

Yet another object of preferred embodiments of the invention is to facilitate mixing by a selected frequency, amplitude or acceleration. Another object of preferred embodiments of the invention is to disperse fine particles in a uniform manner in a Newtonian or non-Newtonian liquid medium. A further object of preferred embodiments of the invention is to cause liquids to migrate into porous solids. Another object of preferred embodiments of the invention is to cause liquids to migrate through porous solids. Another object of preferred embodiments of the invention is to cause liquids to migrate into porous solids and leach out materials. Yet another object of preferred embodiments of the invention is reduce boundary layers that impede mass transport and heat transfer. Another object of preferred embodiments of the invention is to employ resonant operation to improve efficiency of mixing. A further object of preferred embodiments of the invention is to combine three or more masses in such a manner to provide a force-canceling mode of operation. Another object of preferred embodiments of the invention is to produce low-frequencies of 0–1000 Hertz (Hz), high accelerations of 2–75 accelerations equal to that caused by gravity (g's) and large displacement amplitudes of 0.01–0.5 inches. Yet another object of preferred embodiments of the invention is to provide a self-contained system for placing the fluids and solids to be mixed on a platform and a mechanism for securing the system to the platform. Another object of preferred embodiments of the invention is provides a means for force cancellation to the base of the device.

Another object of preferred embodiments of the invention is to reduce acceleration on the oscillator, thereby increasing bearing life and extending the useful life of the components of the device. Yet another object of preferred embodiments of the invention is to provides mechanisms for operation at the resonant frequency of the device for increased efficiency and effectiveness. Another object of preferred embodiment of the invention is to employ internal force cancellation and reduce forces transmitted to the surroundings of the device. A further object of the invention is to efficiently transfer applied forces and related accelerations to the payload mass and reduce acceleration of the oscillator. Another object of preferred embodiments of the invention is to allow for automatic and/or manual adjustment of oscillatory force during operation. Another object of preferred embodiments of the invention is provide a a three, or more, mass system where operating parameters (frequency and displacement) are less sensitive to payload mass changes and provides consistent operation in a variety of situations.

Another object of preferred embodiments of the invention is a device that has three modes of vibration and operates at the highest, thereby affording the use of more compliant springs, which reduces intrinsic damping and increases efficiency. Yet another object of preferred embodiments of the invention is to provide high mass transport of gases, liquids and nutrients to cells with low shear. Another object of the invention is to provide high mass transport of gases and waste products from cells at low shear. A further object of preferred embodiments of the invention is to provide high mass transport of gases, liquids and nutrients to and into microcarriers with low shear while causing a minimum of microcarrier collisions. Another object of preferred embodiments of the invention to provide high mass transport of gases out of and from microcarriers with low shear while causing a minimum of microcarrier collisions.

Yet another object of preferred embodiments of the invention is to provide a vibratory device that can be adjusted to produce frequencies and displacements that cause fluids (gas-liquid, gas-liquid-solid systems and combinations of these systems) in the payload vessel to develop a resonant/mixing condition that establishes high levels of gas-liquid contact, a standing acoustic wave, and axial flow patterns that result in high levels of gas-liquid mass transport and mixing. Another object of preferred embodiments of the invention is to provide a vibratory device that can be adjusted to displace a payload such as a vessel filled with a variety solids that are highly loaded, e.g., very close to theoretical density, at a frequency and amplitude that cause the material to fluidize and become highly mixed. A further object of the invention is to provide a vibratory device that can be adjusted to displace a payload, such as a vessel filled with variety of solids and liquids that are highly loaded, e.g., very close to theoretical density, at a frequency and amplitude to cause the material to fluidize and become highly mixed. Another object of preferred embodiments of the invention is to provide a vibratory device comprised of two or more masses, a substantially linear vibrator and a method of control, which allows for variable force cancellation during operation, the masses being connected by resilient members in order to transfer the forces generated by the vibrator to the vessel and wherein force cancellation is controllable such that substantially linear forces can be generated in any direction.

In a preferred embodiment, the invention is an apparatus comprising: a base assembly comprising a plurality of base legs with each adjacent pair of legs being connected by at least one leg connector assembly, each of said base legs having a bottom resilient member (e.g., spring) support and a top resilient member support attached thereto; a driver assembly, said driver assembly being movable in a first linear direction and in an opposite linear direction and said driver assembly comprising a plurality of resilient member shafts having ends, each of which resilient member shafts has a driver to payload resilient member attached to each end thereof; a plurality of motor assemblies comprising a motor having a motor shaft to which an eccentric mass is attached, each of said eccentric masses having a centroid, each of said motor assemblies being rigidly connected to said driver assembly and being adapted to rotate the centroid of its eccentric mass in a plane that is parallel to another plane in which said first direction and said opposite direction lie; a payload assembly, said payload assembly being movable in the same directions as said driver assembly and being movably connected to said driver assembly by the driver to payload springs and being movably connected to the bottom resilient member support and the top resilient member support of said base assembly by a plurality of payload to base resilient members; and a plurality of reaction mass assemblies, each reaction assembly being movable in the same directions as said driver assembly and being movably connected to said payload assembly by a plurality of reaction mass to payload resilient members and movably connected to said base assembly by a plurality of reaction mass to base resilient members; wherein each of said eccentric masses has substantially the same weight and inertial properties, and wherein the eccentric masses are rotatable at substantially the same rotational speed in opposite rotational directions and around axes that lie in the same plane and, during rotation, are operative to produce a first force on said driver assembly in said first direction and a second force on said driver assembly in said opposite direction and substantially no other forces on said driver assembly. Preferably, the apparatus of further comprises: four base legs; four resilient member shafts; four motor assemblies; and four reaction mass assemblies. Preferably, the apparatus further comprises: a controller that is operative to control the rotation of the motor shafts. Preferably, the apparatus further comprises: a mixing vessel attached to said payload assembly. Preferably, the apparatus further comprises: a motor controller that is operative to cause two of the motor shafts to rotate in a clockwise direction and two of the motor shafts to rotate in a counterclockwise direction. Preferably, apparatus of claim 5 further comprises: an accelerometer that is attached to the payload assembly or to the driver assembly, said accelerometer being operative to produce a first signal that characterizes the motion of the assembly to which it is attached. Preferably, apparatus of further comprises: a polar position transducer (e.g., a resolver) that is attached to each motor shaft, each polar position transducer being operative to produce a second signal that characterizes the absolute position of the motor shaft to which it is attached.

In another preferred embodiment, the invention is a method of mixing comprising: providing an apparatus disclosed herein; and causing the eccentric masses to rotate at substantially the same rotational speed in opposite rotational directions and around axes that lie in the same plane. In yet another preferred embodiment, the invention is a method of mixing comprising: a step for providing an apparatus disclosed herein; a step for placing a composition to be mixed in said mixing chamber; and a step for causing the eccentric masses to rotate at substantially the same rotational speed in opposite rotational directions and around axes that lie in the same plane.

In another preferred embodiment, the invention is an apparatus for agitation comprising: a base; a first movable mass, said first movable mass being movable in a first linear direction and in an opposite linear direction; two means for rotating an eccentric mass, each of said eccentric masses having a centroid, each of said means for rotating being rigidly connected to said first movable mass and being adapted to rotate its eccentric mass in a first plane that is parallel to a second plane in which said first direction and said opposite direction lie; a second movable mass, said second movable mass being movable in the same directions as said first movable mass and being movably connected to said first movable mass by a first resilient means and being movably connected to said base by a second resilient means; and a third movable mass, said third movable mass being movable in the same directions as said first movable mass and being movably connected to said second movable mass by a third resilient means and movably connected to said base by a fourth resilient means; wherein each of said eccentric masses has substantially the same weight and inertial properties, and wherein the eccentric masses are rotatable at substantially the same rotational speed in opposite rotational directions and around axes that lie in the same plane and, during rotation, are operative to produce a first force on said first movable mass in said first direction and a second force on said first movable mass in said opposite direction and substantially no other forces on said first movable mass. Preferably, the apparatus further comprises: a mixing chamber that is rigidly connected to said second movable mass. Preferably, apparatus further comprises: a mixing chamber that is rigidly connected to said third movable mass. Preferably, the apparatus further comprises: first electronic or electro-mechanical means for controlling the frequency at which said second mass or said third mass moves cyclically and/or the displacement of said second mass or third mass as it moves cyclically. Preferably, the apparatus further comprises: second electronic or electro-mechanical means for controlling the frequency at which said second mass or said first mass moves cyclically and/or the displacement of said first mass as it moves cyclically. Preferably, said resilient means have spring constants that are adjustable. Preferably, apparatus further comprises: electronic or electro-mechanical means for automatically adjusting the characteristics of said resilient means, the magnitudes of the forces and the frequency at which the forces are imposed, thereby allowing control of the frequency of vibration or displacement of a payload to provide consistent and/or controlled operation of the apparatus in a variety of situations. Preferably, at least some of the resilient means are selected from the group consisting of spiral springs, leaf springs, pneumatic springs, rubber springs, piezoelectric variable springs, and pneumatic variable springs. Preferably, the second mass comprises a plurality of additional masses, each of additional masses is connected to the third mass by an additional resilient means. Preferably, the third mass comprises a plurality of additional masses, each of additional masses is connected to the second mass by an additional resilient means.

In a further preferred embodiment, the invention is an apparatus for agitation comprising: a base; a first movable mass, said first movable mass being movable in a first linear direction and in an opposite linear direction; means for cyclically imposing forces on said first movable mass in said first direction and in said opposite direction; a second movable mass, said second movable mass being movable in the same directions as said first movable mass and being movably connected to said first movable mass by a first resilient means and being movably connected to said base by a second resilient means; and a third movable mass, said third movable mass being movable in the same directions as said first movable mass and being movably connected to said second movable mass by a third resilient means and movably connected to said base by a fourth resilient means; wherein each of said means for imposing forces is operative to produce a first force on said first movable mass in said first direction and a second force on said first movable mass in said opposite direction and substantially no other forces on said first movable mass. Preferably, the apparatus further comprises: a mixing chamber that is rigidly connected to said second movable mass. Preferably, the apparatus further comprises: a mixing chamber that is rigidly connected to said third movable mass.

In another preferred embodiment, the invention is an apparatus for agitation comprising: a base; a first movable mass, said first movable mass being movable in a first linear direction and in an opposite linear direction; a driver for cyclically imposing a force on said first movable mass in said first direction or in said opposite direction; a second movable mass, said second movable mass being movable in the same directions as said first movable mass and being movably connected to said first movable mass by a first resilient means and being movably connected to said base by a second resilient means; and a third movable mass, said third movable mass being movable in the same directions as said first movable mass and being movably connected to said second movable mass by a third resilient means and movably connected to said base by a fourth resilient means; wherein said driver is operative to produce a first force on said first movable mass in said first direction or a second force on said first movable mass in said opposite direction and substantially no other forces on said first movable mass. Preferably, the apparatus further comprises: four or more independently adjustable and controllable drivers that can be adjusted to control the vibrating force, vibrating amplitude and/or vibrating frequency of said second mass or said third mass.

In a preferred embodiment, the invention is an apparatus for agitation comprising: a base; a first movable mass, said first movable mass being movable in a first linear direction and in an opposite linear direction; two means for rotating an eccentric mass, each of said eccentric masses having a centroid, each of said means for rotating being rigidly connected to said first movable mass and being adapted to rotate its eccentric mass in a first plane that is parallel to a second plane in which said first direction and said opposite direction lie; a second movable mass, said second movable mass being movable in the same directions as said first movable mass and being movably connected to said first movable mass by a first resilient means and being movably connected to said base by a second resilient means; and a third movable mass, said third movable mass being movable in the same directions as said first movable mass and being movably connected to said second movable mass by a third resilient means; wherein each of said eccentric masses has substantially the same weight and inertial properties, and wherein the eccentric masses are capable of rotation at substantially the same rotational speed in opposite rotational directions and around axes that lie in the same plane and, during rotation, are operative to produce a first force on said first movable mass in said first direction and a second force on said first movable mass in said opposite direction and substantially no other forces on said first movable mass. Preferably, the third movable means is connected to said base by a fourth resilient means.

In another preferred embodiment, the invention is a method of mixing comprising: cyclically imposing a first force on a first movable mass in a first linear direction and a second force on said first movable mass in an opposite linear direction relative to a base, said first movable mass being moved in said first linear direction and then in said opposite linear direction; the movement of said first movable mass causing movement of a second movable mass, said second movable mass being movable in the same directions as said first movable mass and being movably connected to said first movable mass by a first resilient means and being movably connected to said base by a second resilient means; the movement of said first movable mass or said second movable mass causing the movement of a third movable mass, said third movable mass being movable in the same directions as said first movable mass and being movably connected to said second movable mass by a third resilient means and movably connected to said base by a fourth resilient means; the movement of said second movable mass or said third movable mass causing mixing of a composition moved by the movement of said second movable mass or said third movable mass.

In yet another preferred embodiment, the invention is a method of mixing comprising: cyclically imposing a first force on a first movable mass in a first linear direction or a second force on said first movable mass in an opposite linear direction relative to a base, said first movable mass being moved in said first linear direction and then in said opposite linear direction; the movement of said first movable mass causing movement of a second movable mass, said second movable mass being movable in the same directions as said first movable mass and being movably connected to said first movable mass by a first resilient means and being movably connected to said base by a second resilient means; the movement of said first movable mass or said second movable mass causing the movement of a third movable mass, said third movable mass being movable in the same directions as said first movable mass and being movably connected to said second movable mass by a third resilient means and movably connected to said base by a fourth resilient means; the movement of said second movable mass or said third movable mass causing mixing of a composition moved by the movement of said second movable mass or said third movable mass. Preferably, the second movable mass or the third movable mass vibrates at the third harmonic and is operative to produce a force canceling effect, thereby reducing or eliminating forces transmitted to the surrounding environment and increasing mixing efficiency.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
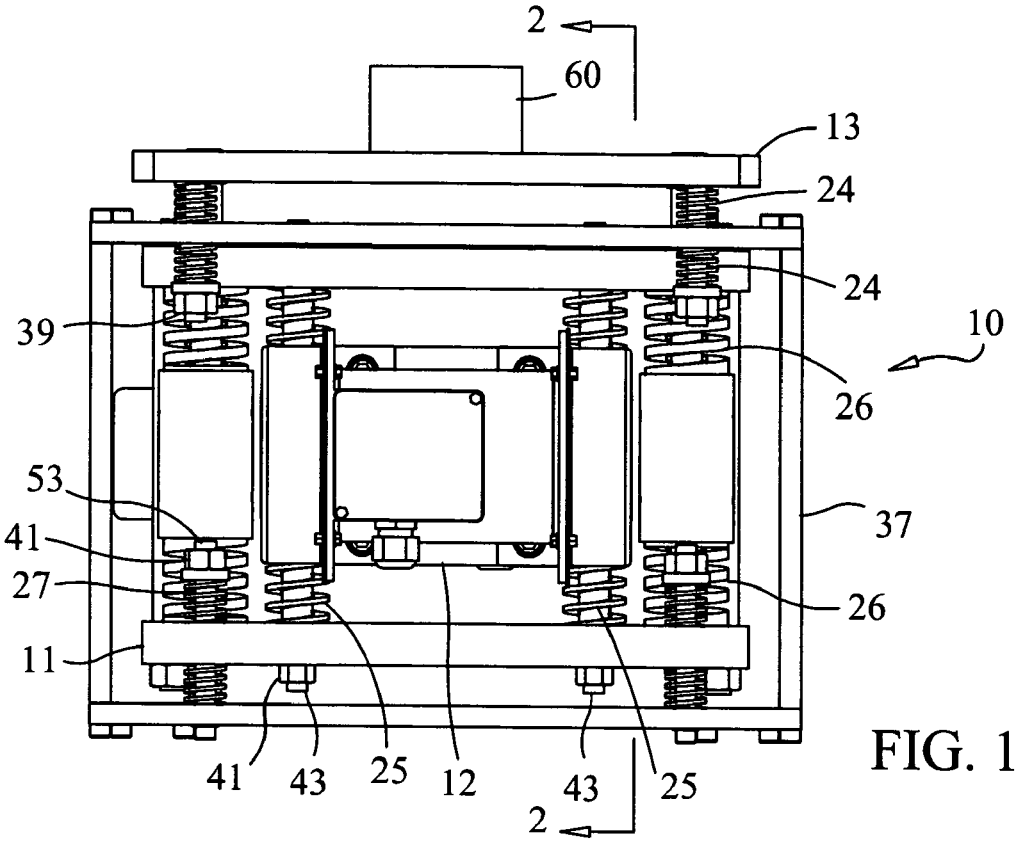
FIG. 1 is a front elevation view of the flat plate resonant reactor constructed in accordance with a first preferred embodiment of the invention with some elements omitted for clarity.

The following reference numerals are used to indicate the parts and environment of the invention on the drawings:

10 device, apparatus

11 intermediate mass

12 oscillator mass

13 payload, payload mass
24 payload mass to ground springs
25 oscillator to intermediate mass springs
26 payload mass to intermediate mass springs
27 intermediate mass to ground springs
30 stops
37 ground frame, base, rigid structure
38 oscillator drives, servo motors, force transducers
39 payload mass to ground alignment struts
40 retainers
41 locking nuts
43 oscillator to intermediate mass alignment struts
53 intermediate mass to ground alignment struts
55 payload mass to intermediate mass struts
56 eccentric masses, eccentric weights, eccentrics
57 motor shafts, shafts
60 mixing chamber
70 resonating system
72 base assembly
74 payload assembly
76 driver assembly
78 reaction mass assembly
80 base legs
82 leg connector assemblies
84 bottom spring support
86 top spring support
88 base foot
100 spans
102 uprights
104 tuning weight
106 base connector
108 reaction mass to base springs
110 reaction mass to payload springs
120 motor block assembly
122 driver to shaft mounts
124 driver spring shafts
126 top spring flange
128 driver to payload springs
130 payload upright supports
132 payload top plate
134 payload bottom plate
136 payload to base springs
138 driver spring shaft holes
140 motor assemblies
142 motor brackets
144 heat sink
146 power connector
148 feedback connector
150 access holes
160 motor stator housing
162 self-aligning bearing
164 wave springs
166 motor stator
168 motor rotor
170 motor shaft
172 keys
174 counterweight
176 counterweight spacer
178 angular contact ball bearing
180 resolver rotor
182 motor weight housing
184 resolver stator
190 retaining ring

DETAILED DESCRIPTION OF THE INVENTION

Referring to FIGS. 1–4, a preferred embodiment of the present invention is presented. Device 10 comprises three independent movable masses (intermediate mass 11, oscillator mass 12 and payload 13) and four distinct spring beds or spring systems (payload mass to ground springs 24, oscillator to intermediate mass springs 25, intermediate mass to payload springs 26 and intermediate mass to ground springs 27) that are housed in rigid structure 7. Oscillator mass 12 is preferably situated between the other two masses. Intermediate mass 11 is preferably situated below oscillator mass 12. Payload 13 is preferably situated above oscillator mass 12. Preferably, all of the masses are constructed of steel or some comparable alloy.

Oscillator mass 12 is rigidly connected to two oscillator drives 38 (e.g., two direct current (DC) servo motors) and is movably connected to intermediate mass 11 by means of oscillator to intermediate mass alignment struts 43 (two of them that are preferably rigidly connected to oscillator mass 12), oscillator to intermediate mass springs 25 (comprising four compliant springs), two retainers 40 and two locking nuts 41. Intermediate mass 11 is movably connected to rigid structure 37 by means of intermediate mass to ground alignment struts 53 (four of them that are preferably rigidly connected to rigid structure 37), intermediate mass to ground springs 27 (comprising eight compliant springs), four retainers 40 and four locking nuts 41. Payload 13 is movably connected to intermediate mass 11 by means of payload mass to intermediate mass struts 55 (two of them that are preferably rigidly connected to payload mass 13), payload mass to intermediate mass springs 26 (comprising four compliant springs), two retainers 41 and two locking nuts 40. One end of payload mass to intermediate mass springs 26 rests on stops 30 that are preferably rigidly connected to payload mass to intermediate mass struts 55. Payload 13 is also movably connected to rigid structure 37 by means of payload mass to ground alignment struts 39 (four of them that are preferably rigidly connected to payload 13), payload mass to ground springs 24 (comprising eight compliant springs), four retainers 40 and four locking nuts 41.

Figure 2:
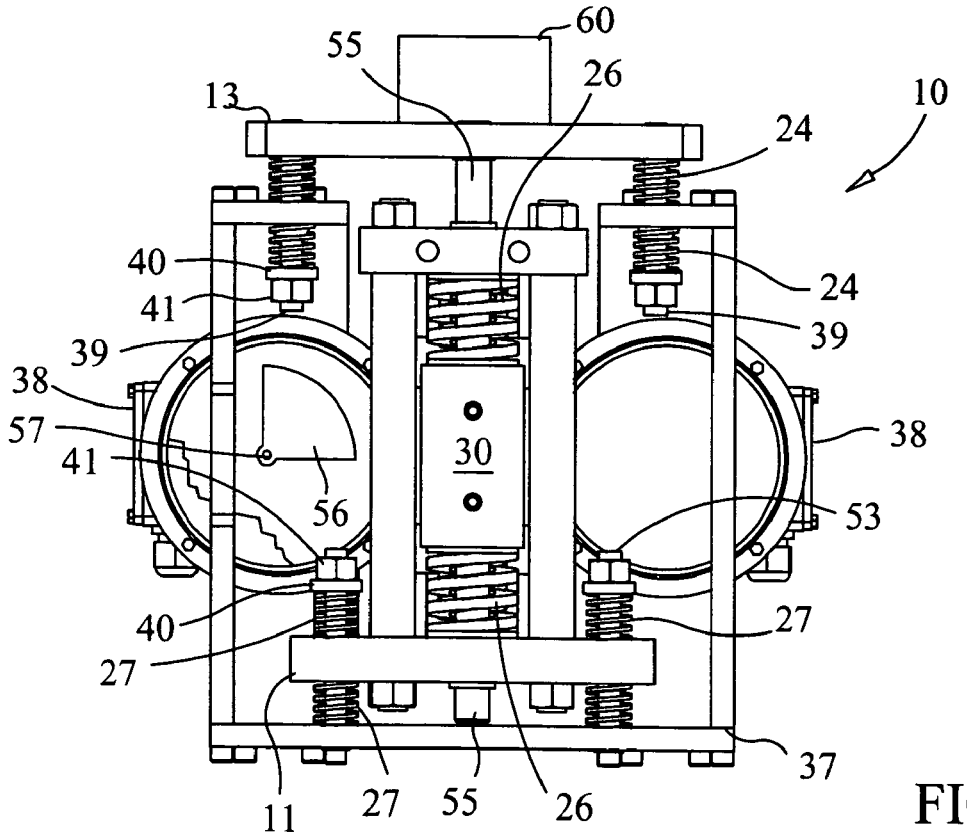
FIG. 2 is a right side sectional view of the flat plate resonant reactor of FIG. 1.

FIG. 2 is a right side view of the embodiment of the invention presented in FIG. 1 showing further detail. It is apparent that intermediate mass 11 supports payload mass 13 and oscillator mass 12 in parallel. Furthermore, oscillator mass 12 is not directly connected to payload mass 13. In this figure, a portion of the cover of one of the servo motors 38 is not shown so that one of the motor shafts 57 and one of the eccentric masses 56 are visible.

In another preferred embodiment, device 10 further comprises mixing chamber 60. Mixing chamber 60 is preferably attached to either intermediate mass 11 or payload 13. The mass that does not have mixing chamber 60 attached to it may also be divided into multiple masses, each with its own resilient member attachment means for attaching the mass to the mass that does not have mixing chamber 60 attached to it.

Figure 3:
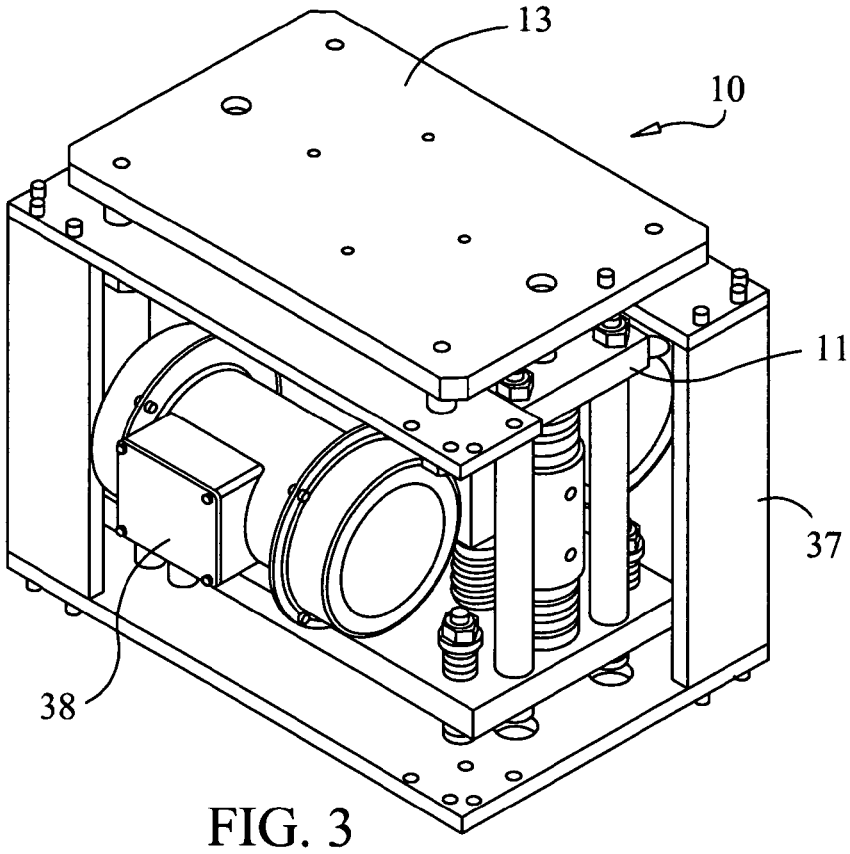
FIG. 3 is a perspective view of the preferred embodiment of FIGS. 1 and 2 with some elements omitted for clarity.
Figure 4:
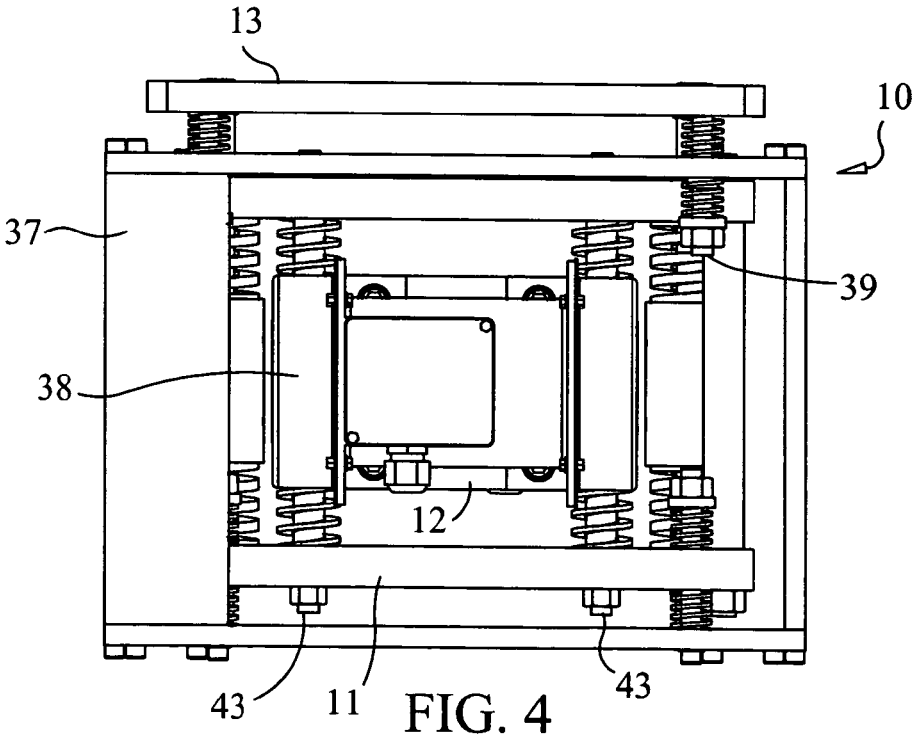
FIG. 4 is a front elevation view of the preferred embodiment of FIGS. 1–4 with some elements omitted for clarity.

Referring to FIGS. 3 and 4, the preferred embodiment of FIGS. 1 and 2 is illustrated with elements deleted from the corner of device 10 that is nearest the viewer in FIG. 3. In these views, both of the oscillator drives 38 are visible.

In yet another preferred embodiment, additional servo motors 38 can be added to device 10 to provide for variability of the impulse force while device 10 is in operation. With the addition of two more servo motors 38 with identical eccentric masses 56, total force cancellation can be achieved. This is accomplished by setting all motor axes to be parallel to one another with two motors rotating clockwise and two motors rotating counterclockwise. Preferably, the eccentric masses 56 are selected so as to cancel out all forces at startup by setting the phase angle to 180 degrees for counter rotating pairs of motors. When the motors have reached the desired frequency of rotation, eccentric masses 56 are moved out of phase, thus creating an impulse force. The phase angle movement is accomplished by decelerating two of the motors for a fraction of a revolution and then reestablishing the selected frequency of rotation such that the eccentric masses no longer oppose each other. Deceleration of the motors is accomplished through a servo motor motion control unit.

Operation of the embodiment of present invention illustrated in FIGS. 1–4 is achieved by the synchronized rotation by servomotors 8 of eccentric weights 56 of equal mass and inertial properties that are attached to each end of shafts 57 of servomotors 38. Synchronization of rotation the two shafts 57 is accomplished by means of electronic controls. The rotating shafts 57 of the two servomotors 38 are oriented parallel to each other and are operated in opposing rotational directions with their eccentric weights 56 opposing each other at the horizontal axis and coincident in the vertical axis. This arraignment produces substantially vertical linear forces with horizontal force cancellation.

The centerline axis of each of the shafts 57 and the centroid of the attached eccentric masses 56 form a mass plane. In the course of one revolution, the initial position has the mass planes parallel to one another with the eccentrics 56 on each shaft above the motor plane defined by the two parallel motor shafts 57. At a quarter turn, the mass planes are coincident with the motor plane and the eccentric weights 56 of each of the shafts 57 are nearest each other. The centrifugal forces created by eccentric masses 56 are translated in the motor plane. This force is of the same magnitude but opposite direction for each of the shafts 57. This effectively cancels the force in the plane of the motor. At one half a revolution, the mass planes are again perpendicular to the motor plane and the eccentrics 56 are all below the motor plane. The centrifugal force acting on each of the shafts 57 is in the same direction, perpendicular to the motor plane. At three quarters of a revolution, the mass planes and the motor plane are again coincident but the eccentric masses 56 of each of the shafts 57 are oriented away from each other. Here again, the centrifugal forces created by the eccentric masses 56 are translated in the motor plane. Again, this force is of the same magnitude but opposite direction for each of the shafts 57. This effectively cancels the force in the plane of the motor. At one full revolution, the mass planes are again perpendicular to the motor plane and the eccentrics 56 are all above the motor plane. The centrifugal force acting on each of the shafts is in the same direction, perpendicular to the motor plane. The force acting perpendicular to the motor plane is translated vertically through connecting springs to intermediate mass 11. A further translation is then achieved through linear guides and springs from intermediate mass 11 to payload mass 13. The springs that comprise spring beds 24, 25, 26 and 27 are selected to optimize force transmission through intermediate mass 11 to payload mass 13 and minimize transmission to supporting structure 37 and surrounding environment.

Operation at resonance is determined when the disparity between the payload mass level of vibration and the driver mass level of vibration is maximized. This resonant condition is dependent on the selected spring/mass system. Preferably, springs characteristics and mass weights are chosen such that the resonant condition is achievable for the anticipated payload weight.

Operation at the resonant condition is not always be required to achieve the level of mixing desired. Operation near resonance provides substantial amplitude and accelerations to produce significant mixing. Desired levels of mixing are set by satisfying time requirements with dispersion requirements. To mix faster or more vigorously, amplitude is increased by operating closer to resonance. Operation is typically within 10 Hz of resonance. As the frequency approaches the resonant condition, small changes produce large results (the slope of the curve—frequency vs. amplitude—changes rapidly as the resonant condition is approached).

Mixing vessel 60 (in which materials are placed for mixing) is preferably attached to payload mass 3. Vigorous mixing is achieved when the transmitted force is converted to acceleration and displacement amplitude thrusting the mix constituents up and down producing a toroidal flow with sub-eddy currents.

In a further preferred embodiment, two more servo motors 38 are added to the mechanism shown in FIGS. 1–4. The two additional servo motors 38 are fitted with eccentric weights 56 having the same physical characteristics as those above noted. With these additional motors 38, control of the impulse force is possible. This is accomplished by controlling the relative phase angle between the two sets of motors 38. In a similar manner as described above, the two sets of servo motors 38 are electrically controlled to accomplish total force cancellation through all frequencies. After the desired frequency has been achieved, the relative phase angle between the two motor sets is changed until the desired impulse force has been achieved. This arraignment has the added advantage of producing variable force and frequency.

In another preferred embodiment, variable resilient members are substituted for springs 24, 25, 26 and/or 27 to provide for changes to the resonant frequency. This addition also allows for a larger variability in the payload without sacrificing performance. Variable resilient members can be either mechanically or electronically controlled. Examples of such devices are air filled bellows, variable length leaf springs, coil spring wedges, piezoelectric bi-metal springs, or any other member which can be used as a resilient member which also has the capability of having its spring rate changed or otherwise affected.

Rather than mix by inducing bulk fluid flow, as is the case for impeller agitation, ResonantSonic® agitation as produced by the present invention mixes by inducing micro-scale turbulence through the propagation of acoustic waves throughout the medium. It is different from ultrasonic agitation because the frequency of acoustic energy is lower and the scale of mixing is larger. Another distinct difference from ultrasonic technology is that the ResonantSonic® devices are simple, mechanically driven agitators that can be made large enough to perform industrial scale tasks at reasonable cost.

A difference between the acoustic agitation technology disclosed herein and conventional impeller agitation is the scale at which complete mixing occurs. In impeller agitation, the mixing occurs through the creation of large scale eddies which are reduced to smaller scale eddies where the energy is dissipated through viscous forces. With acoustic agitation, the mixing occurs through acoustic streaming, which is the time-independent flow of fluid induced by a sound field. It is caused by conservation of momentum dissipated by the absorption and propagation of sound in the fluid. The acoustic streaming transports "micro scale" eddies through the fluid, estimated to be on the order of 100–200 μm. Although the eddies are of a microscale, the entire reactor is well mixed in an extremely short time because the acoustic streaming causes the microscale vortices to be transmitted uniformly throughout the fluid.

Figure 5:
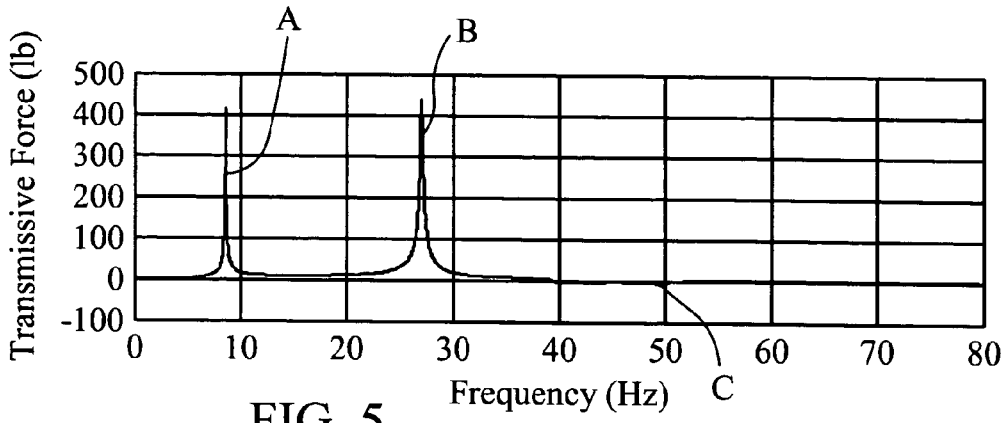
FIG. 5 is a diagram representing the transmissive force response behavior of the preferred embodiment of FIGS. 1–4.

Device 10 in FIGS. 1–4 is preferably operated at resonance to produce intense displacement and acceleration so as to provide vigorous mixing potential. FIG. 5 shows an aspect of the response of the preferred embodiment of the invention presented in FIGS. 1–4 to operation at various oscillator frequencies. The graph shows the force transmitted to the ground by device 10 when operated at each indicated frequency. Operation at the first harmonic frequency of device 10 (point A) and at the second harmonic frequency of device 10 (point B) are indicated by the force peaks shown on the graph In operation, a user selects an operating frequency at or near the third mode (i.e., at or near the third harmonic frequency of device 10 or point C) as appropriate for the desired level of mixing.

Figure 6:
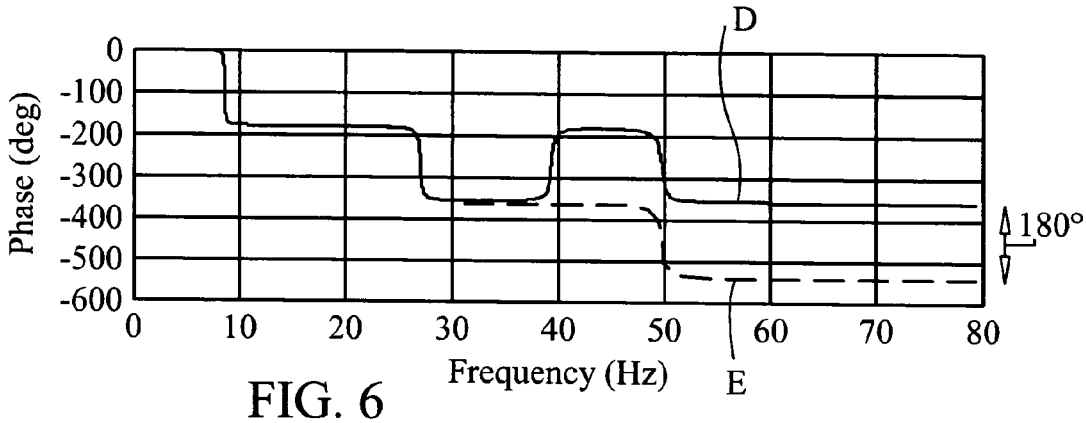
FIG. 6 is a diagram representing the phase response behavior of the preferred embodiment of FIGS. 1–4.

FIG. 6 shows another aspect of the response of the preferred embodiment of the invention presented in FIGS. 1–4 to operation at various oscillator frequencies. The phase of motion of payload mass 13 and the reaction mass (e.g., intermediate mass 11) is illustrated. Above a frequency of about 40 Hetrz (Hz), the phase difference between payload mass 13 and the reaction mass is about 180 degrees, indicating that they are moving in opposite directions.

Figure 7:
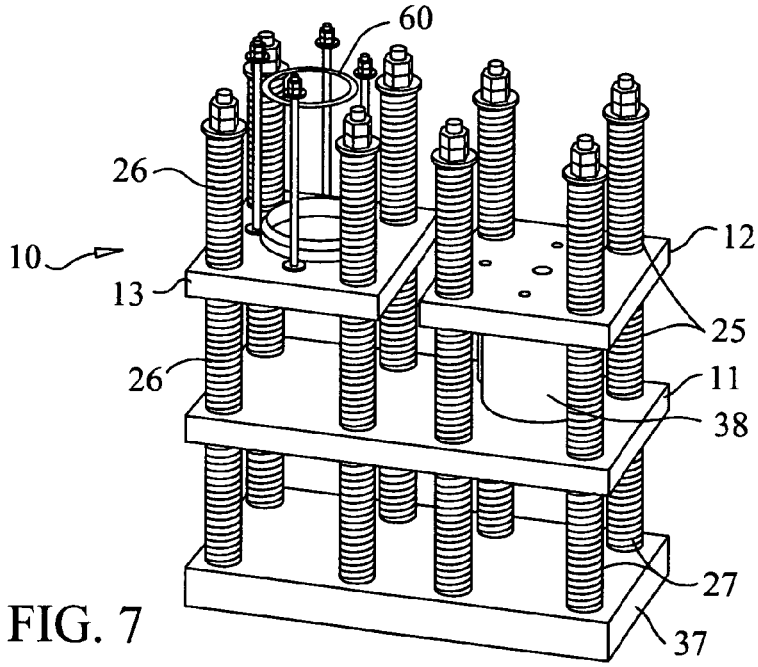
FIG. 7 is a perspective view of an alternative three mass system with a side-mounted vibration drive.
Figure 8:
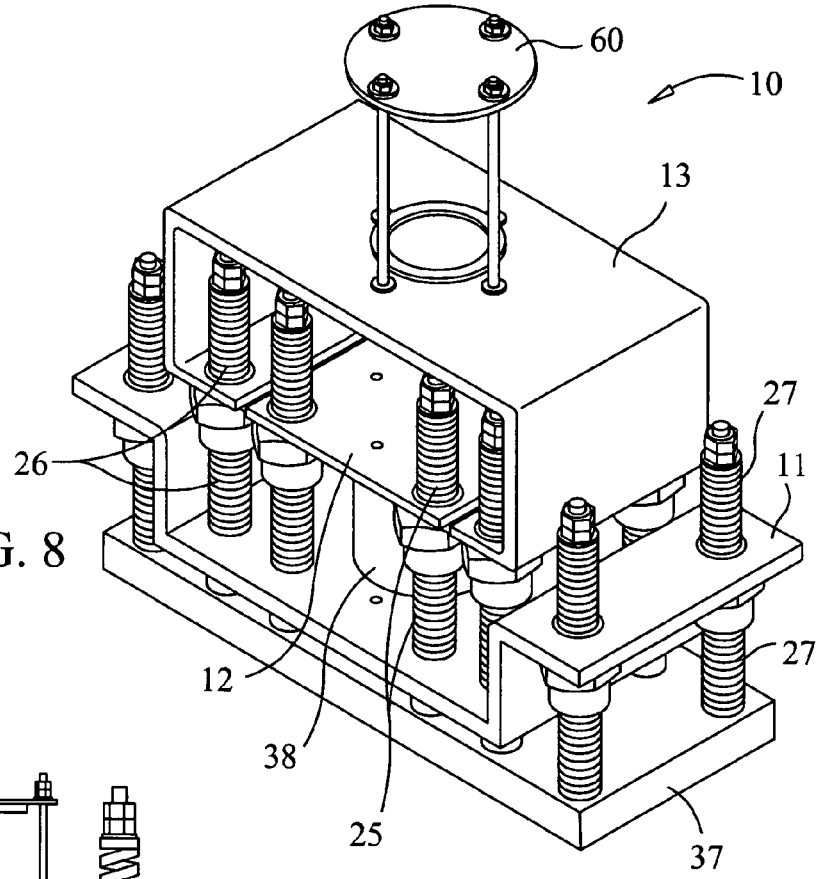
FIG. 8 is a perspective view of an alternative three mass system with a low-mounted vibration drive.
Figure 9:
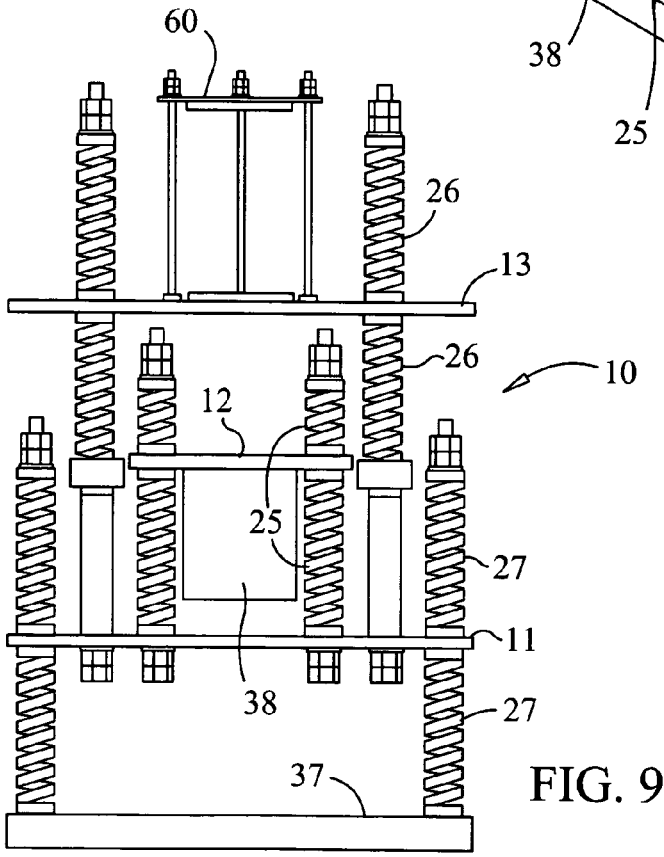
FIG. 9 is a side or front (they are the same) view of an alternative three mass system with middle-mounted vibration drive.

FIGS. 7, 8 and 9 are alternative embodiments of the three mass system of FIGS. 1–4 but differ from those preferred embodiment in the type of force transducers 38 used. These figures depict a device 10 that is excited by linear electromagnetic force transducers 38 as opposed to the servo motors 38 in the preferred embodiment of FIGS. 1–4. All other functions of device 10 are equivalent to the previously described preferred embodiment.

Referring to FIG. 7, a single linear electromagnetic force transducer 38 is rigidly attached to one side of oscillator mass 12. Oscillator mass 12 is movably connected to intermediate mass 11 by means of oscillator to intermediate mass springs 25. Payload mass 13 is movably connected to intermediate mass 11 by means of payload to intermediate mass springs 26. Intermediate mass 11 is movably connected to base 37 by means of intermediate mass to ground springs 27.

Referring to FIG. 8, oscillator mass 12 and payload mass 13 are situated at approximately the same elevation and both are above intermediate mass 12. This illustrates that the relative locations of the masses can vary among embodiments.

Referring to FIG. 9, a single linear electromagnetic force transducer 38 is rigidly attached to the middle of oscillator mass 12. Oscillator mass 12 is movably connected to intermediate mass 11 by means of oscillator to intermediate mass springs 25. Payload mass 13 is movably connected to intermediate mass 11 by means of payload to intermediate mass springs 26. Intermediate mass 11 is movably connected to base 37 by means of intermediate mass to ground springs 27.

Figure 10:
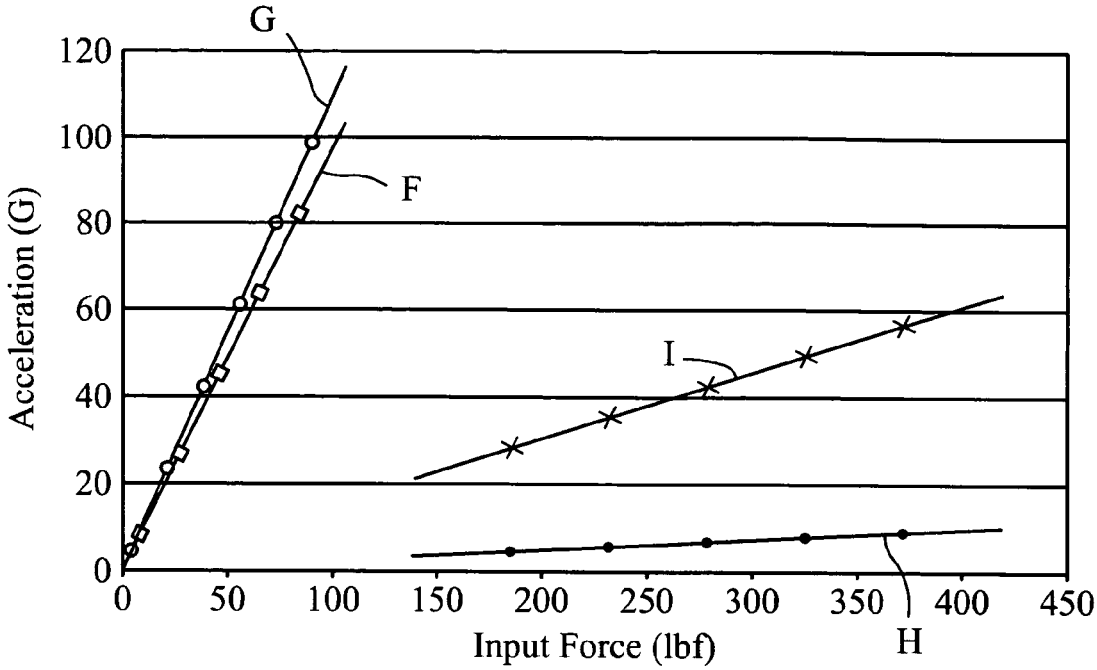
FIG. 10 is a chart showing the performance differences between a two-mass system and a preferred embodiment of a three-mass system.

Referring to FIG. 10, the accelerations produced by three-mass systems of the type disclosed herein are compared to the accelerations produced by two-mass systems disclosed in the background art. The points on line F represent the accelerations of the oscillator mass produced by the associated force inputs and the points on line G represent the accelerations of the payload mass produced by the associated force inputs in a two-mass system. The points on line H represent the accelerations of the oscillator mass produced by the associated force inputs and the points on line I represent the accelerations of the payload mass produced by the associated force inputs in a three-mass system.

Figure 11:
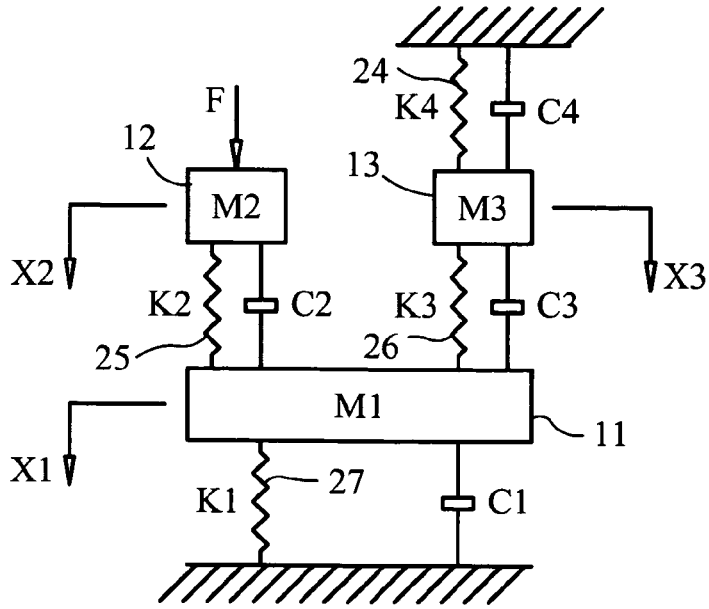
FIG. 11 is schematic free body diagram of a preferred embodiment of the invention.

Referring to FIG. 11, a free body diagram of the preferred embodiment of the invention of FIGS. 1–4 is presented. The following are the equations of motion of device 10:

$$m_1a_1=-k_1x_1-c_1v_1+k_2(x_2-x_1)+k_3(x_3-x_1)+c_2(v_2-v_1)+c_3(v_3-v_1)$$

$$m_2a_2=-k_2(x_2-x_1)-c_2(v_2-v_1)+F$$

$$m_3a_3=-k_3(x_3-x_1)-c_3(v_3-v_1)-k_4x_3-c_4v_3$$

where $m_x$=mass x $k_x$=spring rate of spring x $c_x$=damping coefficient of dash pot x $x_x$=position of mass x $v_x$=velocity of mass x $a_x$=acceleration of mass x F=applied force By solving these equations simultaneously, appropriate weights for the masses and appropriate spring rates and damping coefficients for the springs can be selected for preferred embodiments of the invention. A person having ordinary skill in the art would be capable of writing similar equations for other embodiments of the invention.

There are an infinite number of solutions to the three equations of motion above which describe the motion of the three mass system of device 10. Optimization of the system is dependent upon the desired operation of the system. In general, the selection of mass and spring sizes are subject to maximizing payload amplitude, minimizing forces transmitted to ground and minimizing driver amplitude. A preferred embodiment uses spring ratios as follows; k1/k1=1, k2/k1=4.6, k3/k1=3.9, k4/k11.3, and mass ratios of; m1/m1=1, m2/m1=1.17, m3/m1=0.6. The dashpot constants are a result of natural damping in the preferred embodiment and are not actual components. Therefore, the values of dashpot constants are preferably determined by testing after an embodiment is fabricated.

Figure 12:
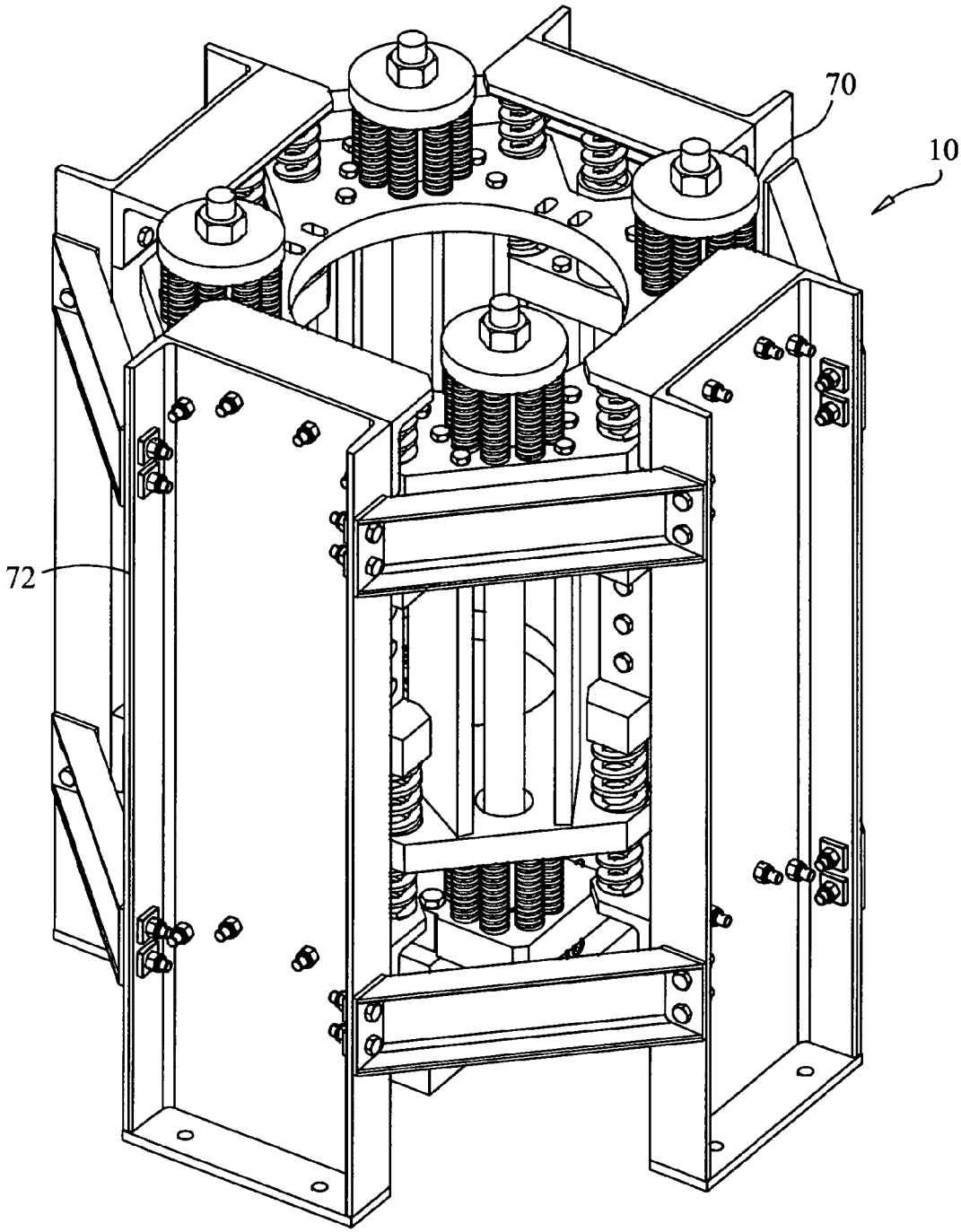
FIG. 12 is a perspective view of a second preferred embodiment of the invention.

Referring to FIGS. 12–19, another preferred embodiment of device 10 is presented. As shown in FIG. 12, resonating system 70 is essentially enclosed by base assembly 72 in this embodiment.

Figure 13:
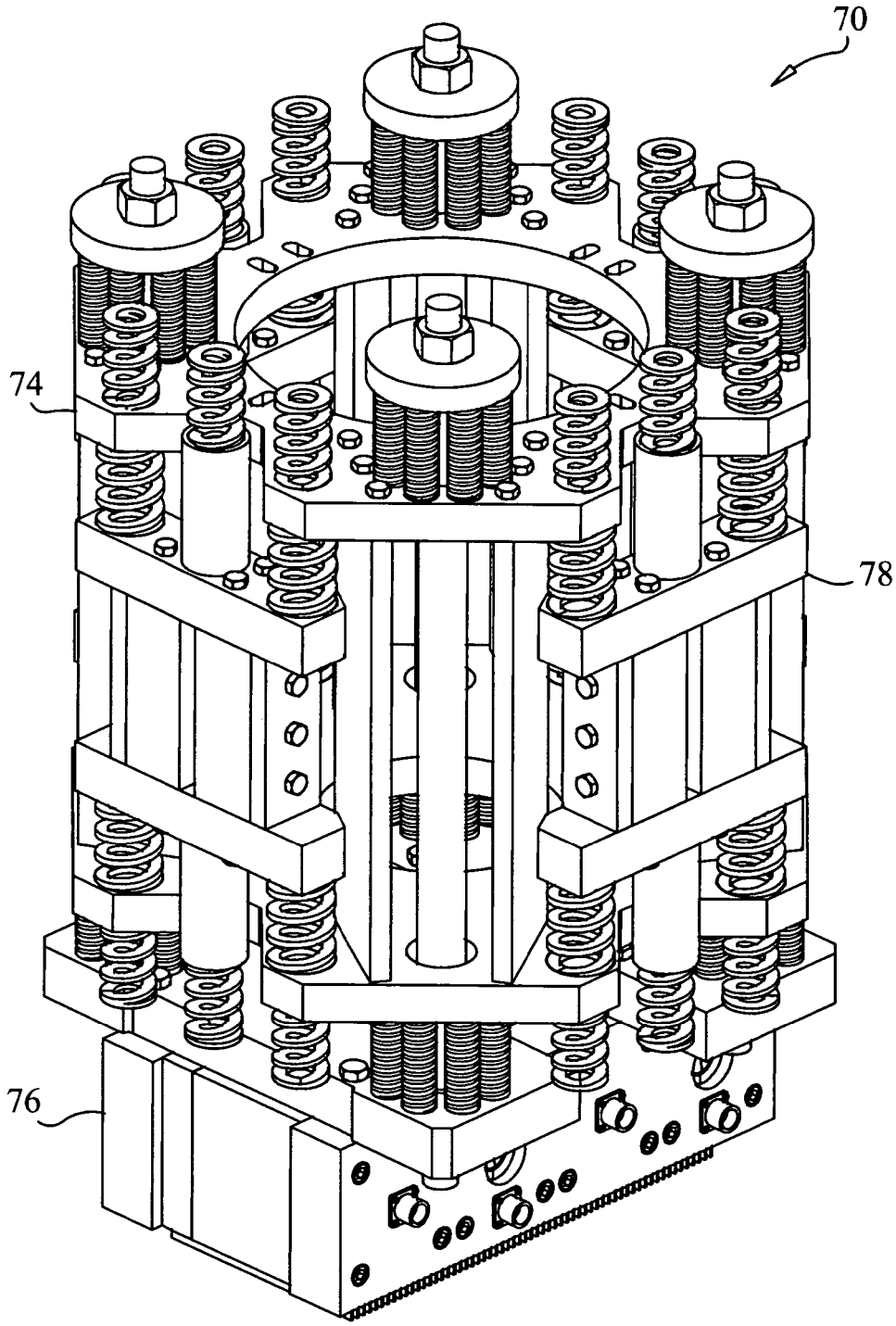
FIG. 13 is a perspective view of the resonating system of the second preferred embodiment of the invention.

Referring to FIG. 13, base assembly 72 is removed from device 10 to show just a preferred embodiment of resonating system 70. In this embodiment, resonating assembly 70 comprises payload assembly 74, driver assembly 76 and reaction mass assembly 78.

Figure 14:
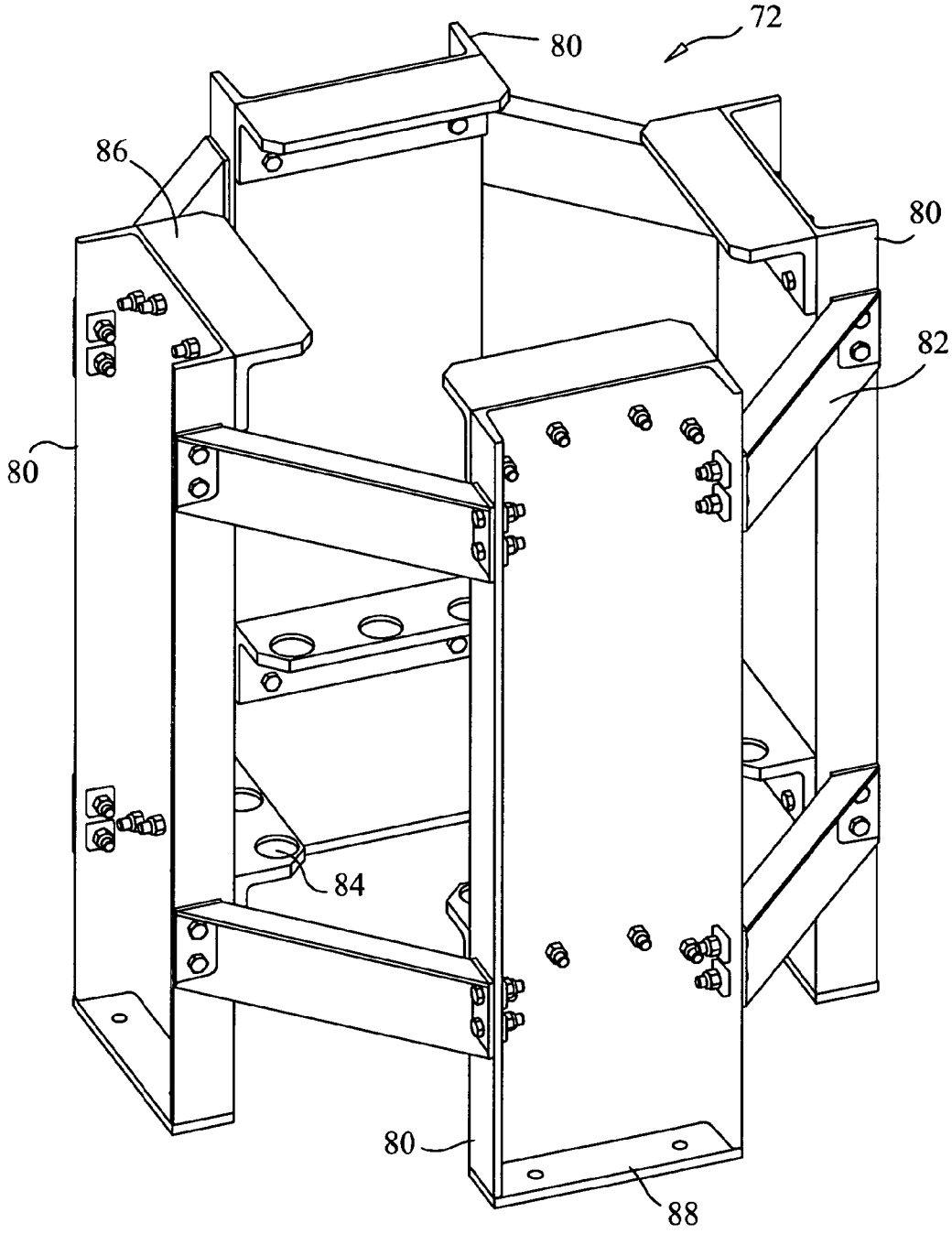
FIG. 14 is a perspective view of the base assembly of the second preferred embodiment of the invention.

Referring to FIG. 14, resonating system 70 is removed from device 10 to show just a preferred embodiment of base assembly 70. Base assembly 70 comprises four base legs 80 with each adjacent pair of the base legs 80 connected by two leg connector assemblies 82. One bottom spring support 84 and one top spring support 86 is attached to each of the base legs 80. Preferably, a base foot 88 is attached to the bottom of each of the base legs 80.

Figure 15:
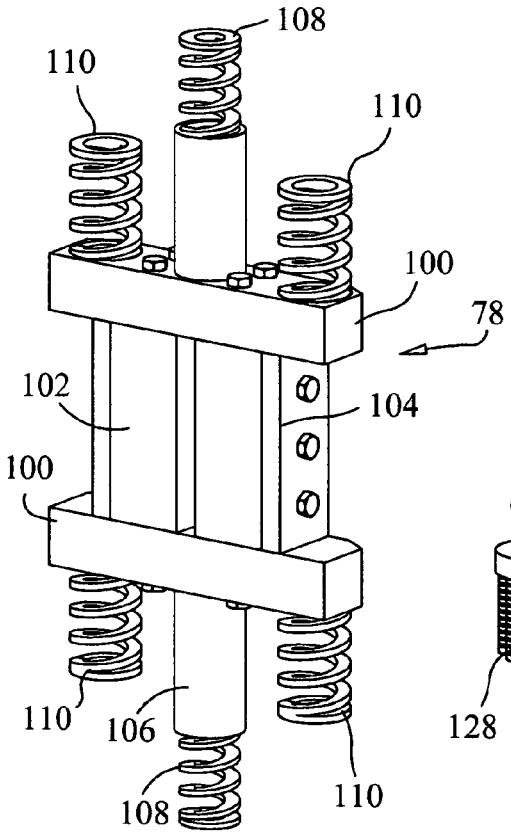
FIG. 15 is a perspective view of a reaction mass assembly of the second preferred embodiment of the invention.

Referring to FIG. 15, a preferred embodiment of reaction mass assembly 78 is presented. In a preferred embodiment, four reaction mass assemblies are included in resonating system 70. In this embodiment, reaction mass assembly 78 comprises two spans 100 that are connected by uprights 102. In a preferred embodiment, a tuning weight 104 is attached to each of the uprights 102. Base connectors 106 support each of the two reaction mass to base springs 108. In a preferred embodiment, reaction mass to base springs 108 are Part No. RHL 200–400 from Moeller Manufacturing Company of Plymouth, Mich. Reaction mass to payload springs 110 movably connect reaction mass assembly 78 to payload assembly 74. In a preferred embodiment, reaction mass to payload springs 110 are Part No. RHL 250-450 from Moeller Manufacturing Company of Plymouth, Mich.

In a preferred embodiment, a three mass system is tuned in such a way as to minimize the transmitted forces to ground. This is accomplished by selecting a reaction mass (mass m3) such that the forces to the ground are canceled out. From FIG. 6, it is evident that the mass m1 (payload mass) and mass m3 (reaction mass) are 180 degrees out of phase (moving in opposite directions). If the weights of the masses are the same, or modified slightly by the natural damping constants, the forces will be canceled for a net force of zero being transferred to ground.

Figure 16:
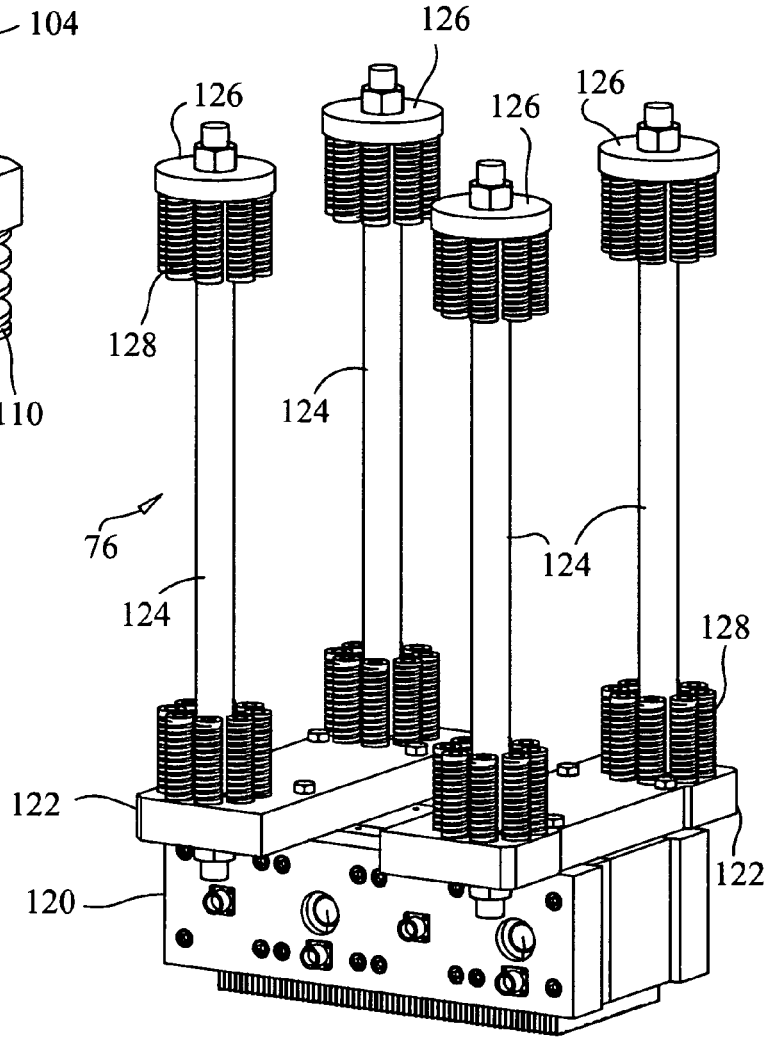
FIG. 16 is a perspective view of the driver assembly of the second preferred embodiment of the invention.

Referring to FIG. 16, a preferred embodiment of driver assembly 76 is presented. In this embodiment, driver assembly 76 comprises motor block assembly 120 to which two driver to shaft mounts 122 are fixed. Two driver spring shafts 124 are attached to the ends of each of the shaft mounts 122. A top spring flange 126 is attached to the top of each of the driver spring shafts 124. In a preferred embodiment, eight driver to payload springs 128 are attached to each end of each of the driver to shaft mounts 122 and to each top spring flange. Driver to payload springs 128 movably connect driver assembly 76 to payload assembly 74. In a preferred embodiment, driver to payload springs 128 are Part No. RHL 125-450 from Moeller Manufacturing Company of Plymouth, Mich.

Figure 17:
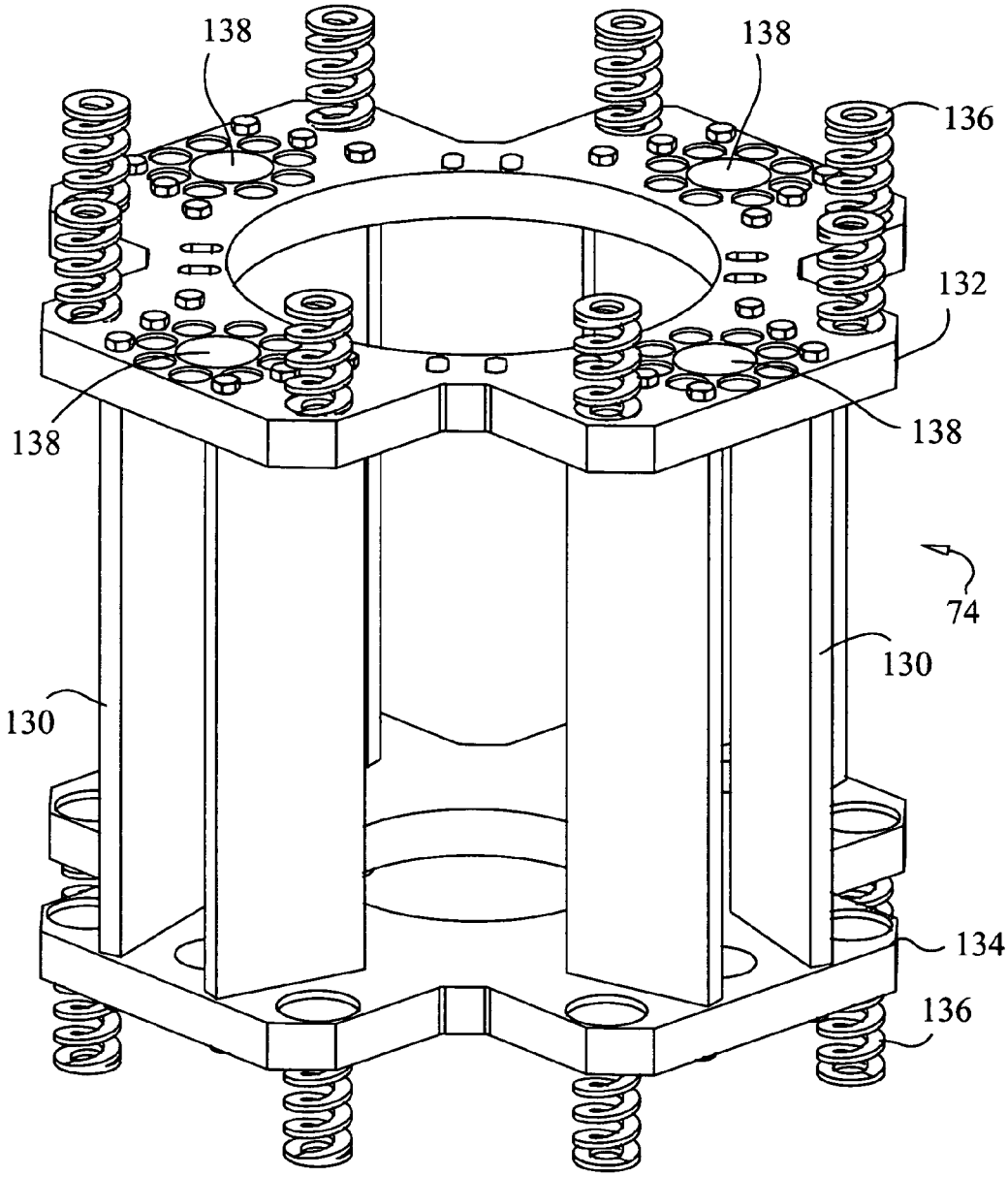
FIG. 17 is a perspective view of the payload assembly of the second preferred embodiment of the invention.

Referring to FIG. 17, a preferred embodiment of payload assembly 74 is presented. In this embodiment, driver assembly 76 comprises eight payload upright supports 130 to which one payload top plate 132 and one payload bottom plate 134 are attached. Both payload top plate 132 and payload bottom plate 134 have four driver spring shaft holes 138 through which the driver spring shafts 124 pass when device 10 is assembled. Preferably, eight payload to base springs 136 are attached to payload top plate 132 and eight payload to base springs 136 are attached to payload bottom plate 134. Payload to base springs 136 movably connect payload assembly 74 to base assembly 72. In a preferred embodiment, payload to base springs 136 are Part No. RHL 200-400 from Moeller Manufacturing Company of Plymouth, Mich.

Figure 18:
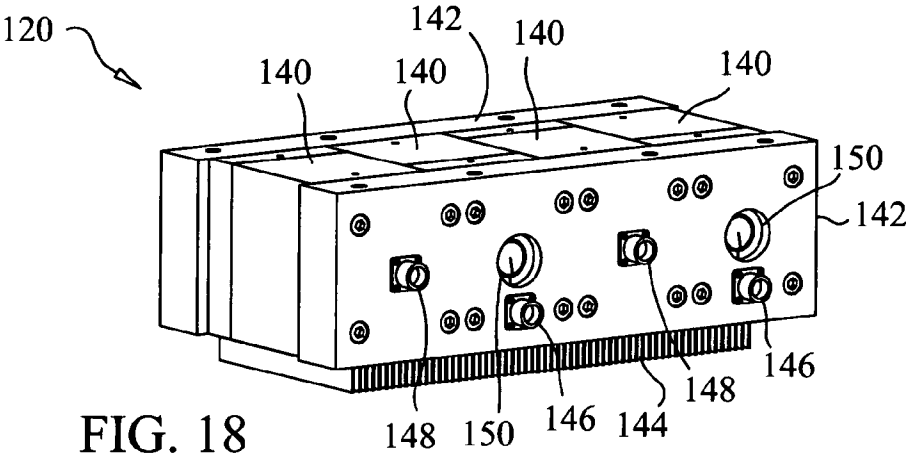
FIG. 18 is a perspective view of the motor block assembly of the second preferred embodiment of the invention.

Referring to FIG. 18, a preferred embodiment of motor block assembly 120 is presented. In this embodiment, motor block assembly 120 comprises four motor assemblies 140, two motor brackets 142 and heat sink 144. Preferably, each of the motor assemblies 140 is connected to a (preferably three-pin) power connector 146 and a (preferably seven-pin) feedback connector 148. One end of the motor shaft 170 of each of the four motor assemblies 140 is preferably visible through two access holes 150 in each of the motor brackets 142. Two of the motor assemblies 140 are oriented toward one of the motor brackets 142 and two of the motor assemblies 140 are oriented toward the other of the motor brackets 142.

Figure 19:
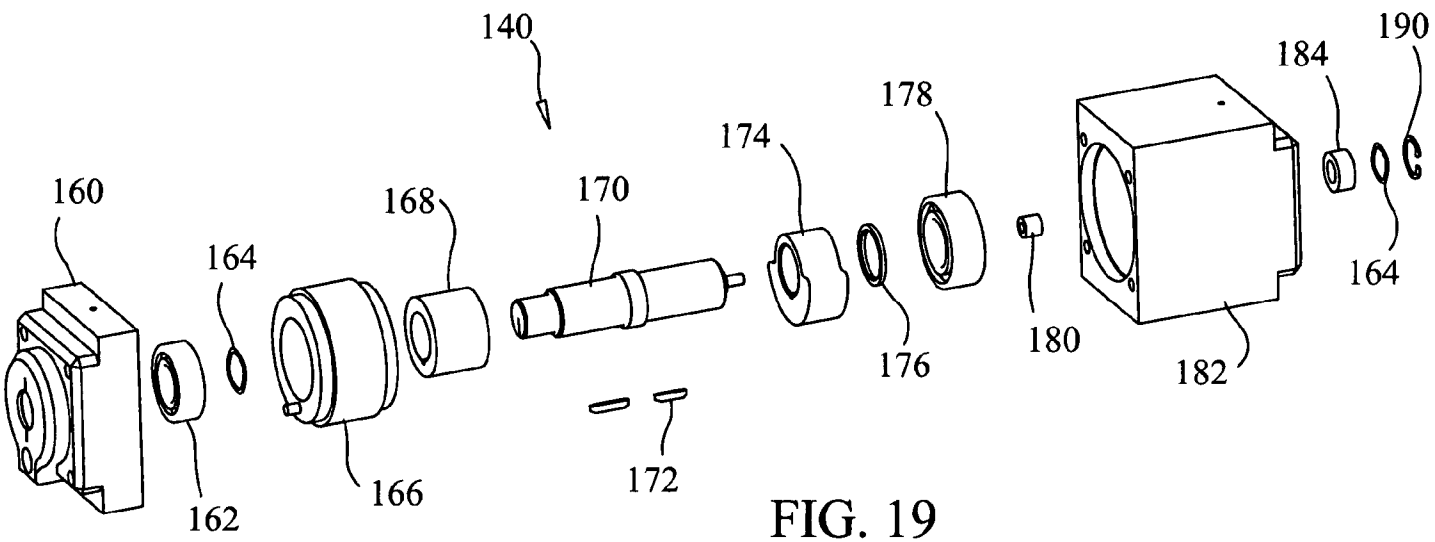
FIG. 19 is a perspective view of a motor assembly of the second preferred embodiment of the invention.

Referring to FIG. 19, a preferred embodiment of each of the motor assemblies 140 is presented. In this embodiment, each of the motor assemblies 140 preferably comprises motor stator housing 160, self-aligning bearing 162, two wave springs 164, motor stator 166, motor rotor 168, motor shaft 170, keys 172, counterweight 174, counter weight spacer 176, angular contact ball bearing 178, resolver rotor 180, motor weight housing 182, resolver stator 184 and retaining ring 190. In a preferred embodiment, the resolver is Model No. JSSB-15-J-05K, Frameless Resolver, manufactured by Northrop Grumman, Poly-Scientific, Blacksburg, Va.

In operation, the motor assemblies 140 of the embodiment of FIGS. 12–19 are activated by a controller (not shown) that causes two of the motor shafts 170 to rotate in a clockwise direction and two to rotate in a counterclockwise direction. As was noted above, the motor shafts 107 are oriented parallel to each other and pairs are operated in opposing rotational directions with pairs of counter weights 174 opposing each other at the horizontal axis and coincident in the vertical axis. As with the other embodiments, this arraignment produces substantially vertical linear forces with horizontal force cancellation.

Variation in the manner of mixing is accomplished using a motor controller or motion controller (not shown) to generate signals to control the frequency and amplitude of the motor assemblies 140 to produce a linear vibratory motion. In alternative embodiment, the motor may be a stepper motor, a linear motor or a direct current (DC) continuous motor. By placing a accelerometer (not shown) on payload assembly 74 and/or motor block assembly 120 to provide feedback control of the mixing motor, the characteristics of agitation in the fluid or solid can be adjusted to optimize the degree of mixing and produce a high quality mixant. In a preferred embodiment, the motor controller is Model No. 6K4, 4-Axis 6K Controller, manufactured by Parker Hannifin Corporation, Compumotor Division, Rohnert Park, Calif. In a preferred embodiment, the accelerometer is a Model No. 793, Accelerometer, manufactured by Wilcoxon Research, Gaithersburg, Md.

Control of a three mass system includes of two primary aspects. The first aspect includes control of the phase angle or relative position of each of the servo motors with respect to each other. Sensors for this are the resolvers which are attached to the shaft of each motor. These devices send an absolute position signal back to the motion controller which tracks the position error from one motor to another. In turn, the motion controller then calculates and sends a correction signal back to the motors. This keeps the motors phase angles within a tolerance which is set in the control code.

The second aspect of the control system is the setting and maintenance of a desired vibration amplitude. This is accomplished by monitoring the amplitude of the payload mass movements (m1) with an accelerometer. Signals from the accelerometer are sent to the motion controller and are compared to a value set by the operator. An error correction signal is then calculated and sent to the motors to increase or decrease their frequency and phase angle to achieve the desired amplitude.

Control of the phase angle control of the motors also has two aspects. The first aspect is to maintain motor to motor position and the second aspect is to control the magnitude of the force input to the system. Maintenance of motor to motor position is necessary so that the resultant force input to the system is oriented in a single direction. This is accomplished by controlling the position of motor pairs. The motors are paired in twos or sets such that each set has identical phase angles. The motor pairs are then set in motion such that they have equal but opposite rotational frequencies. The phase position is then controlled in a manner that sums the resultant forces from the eccentric masses in a singular direction which is parallel to the orientation of the spring axes. Force magnitude is controlled by the controlling the phase angle between motor pairs. If the motor pairs are 180 degrees out of phase with each other, the net resultant force is zero. When the phase angle between motor pairs is zero degrees, the net resultant force is 100 percent of the summation of the four eccentric masses. Phase angles between these extremes result in forces that are lower than the maximum.

In summary, applicants have discovered systems and processes for the application of acoustic energy to a reactor volume that can achieve a high level of uniformity of mixing. The micromixing that is achieved and the effects in the combinations of frequency ranges, displacement ranges and acceleration ranges disclosed herein produce very high-quality mixants. The method disclosed herein can be practiced with the preferred systems disclosed herein and with single mass vibrators, dual mass vibrators, and piezoelectric and magnetostrictive transducers.

Liquid to liquid mixing is enhanced when a composition that comprises a plurality of liquids is exposed a vibratory environment that is preferably operative to vibration the composition at a frequency between about 15 Hz to about 1,000 Hz with an amplitude between about 0.02 inch to about 0.5 inch. Liquids that are not miscible are readily mixed when subjected to this condition. Normal boundary layers which prevent mixing are broken and the liquids are freely and evenly distributed with each other. Micromixing with generation of 10 micron to 100 micron droplets is achieved in this vibratory environment. The uniformity of droplet size and distribution is enhanced by this vibratory process thereby achieving greater mass transport, but the mixture is easily separated when the vibratory agitation is removed. Tuning the process between a preferred frequency between about 15 Hz to about 1,000 Hz with a preferred amplitude between about 0.02 inch to about 0.5 inch optimizes the transfer of acoustic energy into the fluid. This energy then generates an even distribution of droplets (larger than those generated with typical related processes) which collide with each other to affect mass transfer from one droplet to another. After the acoustic energy is removed, the liquids easily and quickly separate thus effecting high mass transfer without creating an emulsion.

Mixing of a composition comprising a liquid, a gas and a solid is enhanced when it occurs in a vibratory environment that is operative to vibrate the composition at a preferred frequency between about 15 Hz to about 1,000 Hz with a preferred amplitude between about 0.02 inch to about 0.5 inch. Fluids (gas-liquid, gas-liquid-solid systems and multiples of these systems) in the payload vessel are caused to develop a resonant/mixing condition that establishes high levels of gas-liquid contact, an acoustic wave, and axial flow patterns that result in high levels of gas-liquid mass transport and mixing.

Non-Newtonian or thixotropic (pseudo plastic) fluids are typically difficult to mix. By placing a composition comprising these fluids in a vibratory environment that is operative to vibrate the composition at a preferred frequency between about 15 Hz to 1,000 Hz with a preferred amplitude between 0.02 inch to 0.5 inch they become fluidized and readily mix. Under these conditions, it is possible to mix such fluids containing one or more solids, one or more gases and one or more liquids.

Mixing of a composition comprising a liquid and a gas is enhanced when it occurs in a vibratory environment that is operative to vibrate the composition at a preferred frequency between about 15 Hz to 1,000 Hz with a preferred amplitude between about 0.02 inch to about 0.5 inch to produce a gasified media. Boundary layers are easily broken and gas is entrained into the fluid. Micro sized bubbles are trapped in the fluid for extended periods of time. This process is particularly effective for the gasification of liquids used to supply gasses to bioreactors. Small bubbles subjected to the acoustic energy produce "bubble pumping." This is the effect of compressing and expanding a bubble trapped in the fluid by acoustic energy. This instability causes the bubbles to be completely engulfed by the fluid at preferred operating conditions. The mass transfer of gas trapped in the bubbles to the liquid is also affected by the increased pressure on the bubble as the acoustic waves pass through the liquid. Henery's law states that the mass transfer of gas to liquid is proportional to the gas pressure in the bubble. This effect is dependent on the head space or volume of gas in relation to the volume of fluid in the mixing vessel. A relatively small volume of gas will produce very small bubbles with higher gas bubble pressure and retention of the bubbles is achieved for longer periods of time after the acoustic agitation is removed.

Mixing in order to remove a gas from a composition comprising a liquid and a gas (degasification) is enhanced when the composition is exposed to a vibratory environment that is operative to vibrate the composition at a lower preferred frequency of about 10 Hz to about 100 Hz and a preferred displacement of less than about 0.025 inch. Reducing the displacement and frequency to these lower levels is particularly useful in driving out entrained gas in fluids. These conditions are effective for both light fluids, such as water, and for highly viscous and solids-loaded fluids.

Physical reactions such as heat transfer, mass transfer and suspension of particles are greatly accelerated by exposing the reactants to a vibratory environment that is operative to vibrate the reactants at a preferred frequency between about 15 Hz to about 1,000 Hz with a preferred amplitude between about 0.02 inch to about 0.5 inch. By placing media containing the reactants in such an environment, the physical forces that generate these reactions are driven at higher rates. Similarly, chemical reactions are increased in rate due to enhanced contact and micro-mixing. The increased rate of media contact and breaking or reduction of boundary layers drives the reactions to occur at increased rates.

Intrusion or infusion of liquids or gases entrained in liquids into a porous solid media is enhanced by placing the porous media in an environment that is operative to vibrate the porous media at a preferred frequency of about 5 Hz to about 1,000 Hz with a preferred amplitude between about 0.02 inch to about 0.5 inch. Boundary layers are broken and fluids and gases are forced into, out of and through the porous structure.

Low shear mixing applications are necessary to prevent damage to biological cultures to reduce damage to the media. This is achieved by placing the cultures in a vibratory environment that is operative to vibrate the cultures at a preferred frequency of about 5 Hz to about 1,000 Hz with a preferred amplitude between about 0.01 inch to about 0.2 inch. The cell cultures are physically mixed with gases, solids and liquids in an environment of low shear and minimal cell to cell collisions. Nutrients and waste products are transported to and from the cell cultures with very low shear. This process also produces more conducive cell culture morphology due to the low shear. Cells are kept from agglomerating into large masses that block mass transfer to and from the individual cells.

Incorporation of a solid into a liquid is enhanced by exposing the solid and liquid to a vibratory environment that is operative to vibrate the combination at a preferred frequency between about 15 Hz to about 1,000 Hz with preferred amplitude between 0.02 inch to 0.5 inch. Incorporation can be so complete it is approaching the theoretical maximum. By placing the fluid and solids in a vibratory environment and, as a result, providing acoustic energy to the media, the effect is to fluidize the mixture. In the process, micro-mixing is accomplished throughout the vessel while macro-mixing the product. Complete and thorough mixing is accomplished by the use of acoustic energy at previously unachievable solids loadings.

Similar to liquids mixing, solids are mixed by adding acoustic energy so that micromixing is achieved. A vibratory environment operating at a preferred frequency between about 15 Hz to about 1,000 Hz with a preferred amplitude between about 0.02 inch to about 0.5 inch provides the necessary acoustic energy required to mix solids. The size of the solids can be nano-sized to much larger particles. The acoustic energy provided to the particles directly acts on the media to produce mixing. Other processes use components such as propellers to produce fluid motion through eddies which then mix the media. These eddies are dampened by the media and thus the mixing is localized near the component creating them. Acoustic energy supplied to the media is not subject to the localization of input because the entire mixing vessel volume is subject to the energy at the same time.

Many variations of the invention will occur to those skilled in the art. Some variations include embodiments wherein the oscillator mass is connected to the intermediate mass by springs and the intermediate mass is connected to the payload mass by springs. Other variations call for embodiments wherein the oscillator mass is connected to the payload mass by springs and the payload mass is connected to the intermediate mass by springs. All such variations are intended to be within the scope and spirit of the invention.

Although some embodiments are shown to include certain features, the applicant(s) specifically contemplate that any feature disclosed herein may be used together or in combination with any other feature on any embodiment of the invention. It is also contemplated that any feature may be specifically excluded from any embodiment of an invention.

What is claimed is:

1. An apparatus comprising:

a base assembly comprising a plurality of base legs with each adjacent pair of legs being connected by at least one leg connector assembly, each of said base legs having a bottom resilient member support and a top resilient member support attached thereto;

a driver assembly, said driver assembly being movable in a first linear direction and in an opposite linear direction and said driver assembly comprising a plurality of resilient member shafts having ends, each of which resilient member shafts has a driver to payload resilient member attached to each end thereof;

a plurality of motor assemblies comprising a motor having a motor shaft to which an eccentric mass is attached, each of said eccentric masses having a centroid, each of said motor assemblies being rigidly connected to said driver assembly and being adapted to rotate the centroid of its eccentric mass in a plane that is parallel to another plane in which said first direction and said opposite direction lie;

a payload assembly, said payload assembly being movable in the same directions as said driver assembly and being movably connected to said driver assembly by the driver to payload resilient members and being movably connected to the bottom resilient member support and the top resilient member support of said base assembly by a plurality of payload to base resilient members; and a plurality of reaction mass assemblies, each reaction mass assembly being movable in the same directions as said driver assembly and being movably connected to said payload assembly by a plurality of reaction mass to payload resilient members and movably connected to said base assembly by a plurality of reaction mass to base resilient members;

wherein each of said eccentric masses has substantially the same weight and inertial properties, and wherein the eccentric masses are rotatable at substantially the same rotational speed in opposite rotational directions and around axes that lie in the same plane and, during rotation, are operative to produce a first force on said driver assembly in said first direction and a second force on said driver assembly in said opposite direction and substantially no other forces on said driver assembly.

2. The apparatus of claim 1 further comprising:

four base legs;

four resilient member shafts;

four motor assemblies; and four reaction mass assemblies.

3. The apparatus of claim 2 further comprising:

a motor controller that is operative to cause two of the motor shafts to rotate in a clockwise direction and two of the motor shafts to rotate in a counterclockwise direction.

4. The apparatus of claim 3 further comprising:

an accelerometer that is attached to the payload assembly or to the driver assembly, said accelerometer being operative to produce a first signal that characterizes the motion of the assembly to which it is attached.

5. The apparatus of claim 3 further comprising:

a polar position transducer that is attached to each motor shaft, each polar position transducer being operative to produce a second signal that characterizes the absolute position of the motor shaft to which it is attached.

6. A method of mixing comprising:

a step for providing the apparatus of claim 5;

a step for placing a composition to be mixed in said mixing chamber; and a step for causing the eccentric masses to rotate at substantially the same rotational speed in opposite rotational directions and around axes that lie in the same plane.

7. The apparatus of claim 1 further comprising:

a controller that is operative to control the rotation of the motor shafts.

8. The apparatus of claim 1 further comprising:

a mixing chamber attached to said payload assembly.

9. A method of mixing comprising:

a step for providing the apparatus of claim 8;

a step for placing a composition to be mixed in said mixing chamber; and a step for causing the eccentric masses to rotate at substantially the same rotational speed in opposite rotational directions and around axes that lie in the same plane.

10. A method of mixing comprising:

providing the apparatus of claim 1; and causing the eccentric masses to rotate at substantially the same rotational speed in opposite rotational directions and around axes that lie in the same plane.

11. An apparatus for agitation comprising:

a base;

a first movable mass, said first movable mass being movable in a first linear direction and in an opposite linear direction;

two means for rotating an eccentric mass, each of said eccentric masses having a centroid, each of said means for rotating being rigidly connected to said first movable mass and being adapted to rotate its eccentric mass in a first plane that is parallel to a second plane in which said first direction and said opposite direction lie;

a second movable mass, said second movable mass being movable in the same directions as said first movable mass and being movably connected to said first movable mass by a first resilient means and being movably connected to said base by a second resilient means; and a third movable mass, said third movable mass being movable in the same directions as said first movable mass and being movably connected to said second movable mass by a third resilient means and movably connected to said base by a fourth resilient means;

wherein each of said eccentric masses has substantially the same weight and inertial properties, and wherein the eccentric masses are rotatable at substantially the same rotational speed in opposite rotational directions and around axes that lie in the same plane and, during rotation, are operative to produce a first force on said first movable mass in said first direction and a second force on said first movable mass in said opposite direction and substantially no other forces on said first movable mass.

12. The apparatus of claim 11 further comprising:

a mixing chamber that is rigidly connected to said second movable mass.

13. A method of mixing comprising:

a step for providing the apparatus of claim 12, a step for placing a composition to be mixed in said mixing chamber; and a step for causing the eccentric masses to rotate at substantially the same rotational speed in opposite rotational directions and around axes that lie in the same plane.

14. The apparatus of claim 11 further comprising:

a mixing chamber that is rigidly connected to said third movable mass.

15. A method of mixing comprising:

providing the apparatus of claim 14;

placing a composition to be mixed in said mixing chamber; and causing the eccentric masses to rotate at substantially the same rotational speed in opposite rotational directions and around axes that lie in the same plane.

16. A process for mixing a composition that comprises a plurality of liquids, said process comprising:

providing the apparatus of claim 14;

placing the composition to be mired into said mixing chamber; and exposing the composition to a vibratory environment that is operative to vibrate the composition at a frequency between about 15 Hertz to about 1,000 Hertz and at an amplitude between about 0.02 inch to about 0–5 inch.

17. A process for removing a gas from a composition comprising a liquid and a gas, said process comprising:

providing the apparatus of claim 14;

placing the composition to be mixed into said mixing chamber; and exposing the composition to a vibratory environment that is operative to vibrate the composition at a frequency between about 10 Hertz to about 100 Hertz and at an amplitude of less than about 0.025 inch.

18. A process for increasing the rate of a reaction among reactants, said process comprising:

providing the apparatus of claim 14;

placing the reactants into said mixing chamber; and exposing the composition to a vibratory environment that is operative to vibrate the composition at a frequency between about 10 Hertz to about 100 Hertz and at an amplitude of less than about 0.025 inch.

19. A process for increasing the rate of intrusion or infusion of a first liquid or a gas entrained in a second liquid into a porous solid media, said process comprising:

providing the apparatus of claim 14;

placing the porous solid media or the first liquid or the gas entrained in the second liquid into said mixing chamber; and exposing the porous solid media and the first liquid or the gas entrained in the second liquid to a vibratory environment that is operative to vibrate the porous solid media and the first liquid or the gas entrained in the second liquid at a frequency between about 5 Hertz to about 1,000 Hertz and at an amplitude of less than about 0.02 inch to about 0.5 inch.

20. A process for mixing a biological culture that comprises a nutrient medium and a microorganism, said process comprising:

providing the apparatus of claim 14;

placing the culture to be mixed into said mixing chamber; and exposing the composition to a vibratory environment that is operative to vibrate the composition at a frequency between about 5 Hertz to about 1,000 Hertz and at an amplitude between about 0.01 inch to about 0.2 inch.

21. A process for incorporation of a solid into a liquid, said process comprising:

providing the apparatus of claim 14;

placing the solid and the liquid to be mixed into said mixing chamber; and exposing the solid and the liquid to a vibratory environment that is operative to vibrate the composition at a frequency between about 15 Hertz to about 1,000 Hertz and at an amplitude between about 0.02 inch to about 0.5 inch.

22. The apparatus of claim 11 further comprising:

first electronic or electro-mechanical means for controlling the frequency at which said second mass or said third mass moves cyclically and/or the displacement of said second mass or third mass as it moves cyclically.

23. The apparatus of claim 11 further comprising:

second electronic or electro-mechanical means for controlling the frequency at which said second mass or said first mass moves cyclically and/or the displacement of said first mass as it moves cyclically.

24. The apparatus of claim 11 wherein said resilient means have spring constants that are adjustable.

25. The apparatus of claim 11 further comprising:

electronic or electro-mechanical means for automatically adjusting the characteristics of said resilient means, the magnitudes of the forces and the frequency at which the forces are imposed, thereby allowing control of the frequency of vibration or displacement of a payload to provide consistent and/or controlled operation of the apparatus in a variety of situations.

26. The apparatus of claim 11 wherein at least some of the resilient means are selected from the group consisting of spiral springs, leaf springs, pneumatic springs, rubber springs, piezoelectric variable springs, and pneumatic variable springs.

27. The apparatus of claim 11 wherein the second mass comprises a plurality of additional masses, each of additional masses is connected to the third mass by an additional resilient means.

28. The apparatus of claim 11 wherein the third mass comprises a plurality of additional masses, each of additional masses is connected to the second mass by an additional resilient means.

29. A method of mixing comprising:

providing the apparatus of claim 11; and causing the eccentric masses to rotate at substantially the same rotational speed in opposite rotational directions and around axes that lie in the same plane.

30. An apparatus for agitation comprising:

a base;

a first movable mass, said first movable mass being movable in a first linear direction and in an opposite linear direction;

means for cyclically imposing forces on said first movable mass in said first direction and in said opposite direction;

a second movable mass, said second movable mass being movable in the same directions as said first movable mass and being movably connected to said first movable mass by a first resilient means and being movably connected to said base by a second resilient means; and a third movable mass, said third movable mass being movable in the same directions as said first movable mass and being movably connected to said second movable mass by a third resilient means and movably connected to said base by a fourth resilient means;

wherein each of said means for imposing forces is operative to produce a first force on said first movable mass in said first direction and a second force on said first movable mass in said opposite direction and substantially no other forces on said first movable mass.

31. The apparatus of claim 30 further comprising:

a mixing chamber that is rigidly connected to said second movable mass.

32. The apparatus of claim 30 further comprising:

a mixing chamber that is rigidly connected to said third movable mass.

33. An apparatus for agitation comprising:

a base;

a first movable mass, said first movable mass being movable in a first linear direction and in an opposite linear direction;

a driver for cyclically imposing a force on said first movable mass in said first direction or in said opposite direction;

a second movable mass, said second movable mass being movable in the same directions as said first movable mass and being movably connected to said first movable mass by a first resilient means and being movably connected to said base by a second resilient means; and a third movable mass, said third movable mass being movable in the same directions as said first movable mass and being movably connected to said second movable mass by a third resilient means and movably connected to said base by a fourth resilient means;

wherein said driver is operative to produce a first force on said first movable mass in said first direction or a second force on said first movable mass in said opposite direction and substantially no other forces on said first movable mass.

34. The apparatus of claim 33 further comprising:

four or more independently adjustable and controllable drivers that can be adjusted to control the vibrating force, vibrating amplitude and/or vibrating frequency of said second mass or said third mass.

35. An apparatus for agitation comprising:

a base;

a first movable mass, said first movable mass being movable in a first linear direction and in an opposite linear direction;

two means for rotating an eccentric mass, each of said eccentric masses having a centroid, each of said means for rotating being rigidly connected to said first movable mass and being adapted to rotate its eccentric mass in a first plane that is parallel to a second plane in which said first direction and said opposite direction lie;

a second movable mass, said second movable mass being movable in the same directions as said first movable mass and being movably connected to said first movable mass by a first resilient means and being movably connected to said base by a second resilient means; and a third movable mass, said third movable mass being movable in the same directions as said first movable mass and being movably connected to said second movable mass by a third resilient means;

wherein each of said eccentric masses has substantially the same weight and inertial properties, and wherein the eccentric masses are capable of rotation at substantially the same rotational speed in opposite rotational directions and around axes that lie in the same plane and, during rotation, are operative to produce a first force on said first movable mass in said first direction and a second force on said first movable mass in said opposite direction and substantially no other forces on said first movable mass.

36. The apparatus of claim 35 wherein the third movable means is connected to said base by a fourth resilient means.

* * * * *